US010376040B2

(12) United States Patent
Davies-Smith et al.

(10) Patent No.: US 10,376,040 B2
(45) Date of Patent: Aug. 13, 2019

(54) FLUID SUPPLY APPARATUS AND PERSONAL CARE IMPLEMENT CONTAINING THE SAME

(71) Applicant: Colgate-Palmolive Company, New York, NY (US)

(72) Inventors: Leighton Davies-Smith, Lebanon, NJ (US); Al Aquanza Sprosta, Maplewood, NJ (US); Shyamala Pillai, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 55 days.

(21) Appl. No.: 15/840,705

(22) Filed: Dec. 13, 2017

(65) Prior Publication Data

US 2018/0168328 A1 Jun. 21, 2018

Related U.S. Application Data

(60) Provisional application No. 62/436,786, filed on Dec. 20, 2016.

(51) Int. Cl.
*A46B 11/04* (2006.01)
*A46B 11/00* (2006.01)
(Continued)

(52) U.S. Cl.
CPC ..... *A46B 11/0079* (2013.01); *A46B 9/04* (2013.01); *A46B 11/002* (2013.01);
(Continued)

(58) Field of Classification Search
CPC ..... A46B 11/002; A46B 11/0062; A46B 11/0072; A46B 11/0079; A46B 2200/1066
(Continued)

(56) References Cited

U.S. PATENT DOCUMENTS 1,973,212 A 9/1934 Krueger
3,741,668 A 6/1973 Danjzcek et al.
(Continued)

FOREIGN PATENT DOCUMENTS

CN 2382559 6/2000
DE 2754338 6/1979
(Continued)

OTHER PUBLICATIONS

International Search Report and Written Opinion of the International Searching Authority in International Application No. PCT/US2017/066120, dated Mar. 26, 2018.

*Primary Examiner* — Jennifer C Chiang

(57) ABSTRACT

A fluid supply apparatus with leakage protection. The apparatus includes a housing defining a storage cavity having a total volume including a fluid portion and a gas portion. The storage cavity extends along a cavity axis from a first end to a second end. A capillary member is fluidly coupled with the fluid. A plurality of vent apertures are formed into the housing, each forming a passageway between the storage cavity and an external atmosphere and each configured such that the fluid cannot flow through the vent apertures at ambient temperature and pressure equilibrium between the storage cavity and the external atmosphere. The vent apertures may be located and arranged on the housing such that irrespective of vertical and angular orientation of the housing relative to a gravitational vector at least one of the vent apertures is in spatial communication with the gas.

20 Claims, 17 Drawing Sheets

(51) Int. Cl.
*A46B 9/04* (2006.01)
*A46B 15/00* (2006.01)

(52) U.S. Cl.
CPC ..... *A46B 11/0062* (2013.01); *A46B 15/0051* (2013.01); *A46B 2200/1066* (2013.01)

(58) Field of Classification Search
USPC ..... 401/198, 270
See application file for complete search history.

(56) References Cited

U.S. PATENT DOCUMENTS

| | | | |
|---|---|---|---|
| 3,873,218 | A | 3/1975 | Yoshida |
| 4,155,663 | A | 5/1979 | Cerquozzi |
| 4,207,012 | A | 6/1980 | Kuparinen |
| 4,530,369 | A | 7/1985 | Adams |
| 4,753,546 | A | 6/1988 | Witz et al. |
| 4,770,558 | A | 9/1988 | Frietsch |
| 4,886,389 | A | 12/1989 | Vidovic |
| 5,033,898 | A | 7/1991 | Williams |
| 5,062,728 | A | 11/1991 | Kuo |
| 5,096,319 | A | 3/1992 | Gueret |
| 5,098,297 | A | 3/1992 | Chari et al. |
| D337,659 | S | 7/1993 | Lacy |
| 5,242,233 | A | 9/1993 | Sirota |
| 5,611,687 | A | 3/1997 | Wagner |
| 6,345,405 | B1 | 2/2002 | Brackin |
| 6,371,674 | B1 | 4/2002 | Lerner |
| 6,416,242 | B1 | 7/2002 | Kaufmann |
| 6,659,671 | B1 | 12/2003 | Fukami et al. |
| 6,699,038 | B2 | 3/2004 | Stewart |
| 7,887,246 | B2 | 2/2011 | Hori |
| 8,398,326 | B2 | 3/2013 | Jimenez et al. |
| 8,529,150 | B2 | 9/2013 | Olson |
| 9,237,798 | B2 | 1/2016 | Kennedy et al. |
| 9,648,943 | B2 | 5/2017 | Jimenez et al. |
| 9,700,130 | B2 * | 7/2017 | Kennedy ..... A46B 15/0061 |
| 2002/0192007 | A1 | 12/2002 | Lee |
| 2004/0237226 | A1 | 12/2004 | Hohlbein et al. |
| 2004/0255416 | A1 | 12/2004 | Hohlbein |
| 2008/0014010 | A1 | 1/2008 | Bartschi et al. |
| 2017/0215574 | A1 | 8/2017 | Jimenez et al. |

FOREIGN PATENT DOCUMENTS

| | | |
|---|---|---|
| DE | 40 14642 | 4/1991 |
| DE | 100 35 214 | 2/2002 |
| EP | 0624483 | 11/1994 |
| EP | 1 017 297 | 6/2002 |
| FR | 2 448 982 | 9/1980 |
| GB | 801603 | 9/1958 |
| WO | 2003/101760 | 12/2003 |

* cited by examiner

FLUID SUPPLY APPARATUS AND PERSONAL CARE IMPLEMENT CONTAINING THE SAME

CROSS-REFERENCE TO RELATED APPLICATIONS

The present application claims the benefit of U.S. Provisional Application Ser. No. 62/436,786, filed Dec. 20, 2016, the entirety of which is incorporated herein by reference.

BACKGROUND

Fluid supply apparatuses are used to store a fluid that is later dispensed onto a surface. Examples of fluid supply apparatuses include writing instruments, liquid dispensers, liquid applicators, and the like. Personal care implements, particularly oral care implements such as toothbrushes, are typically used by applying dentifrice or toothpaste to tooth cleaning elements such as bristles followed by brushing regions of the oral cavity, e.g., the teeth, tongue, and/or gums. Some oral care implements have been equipped with fluid reservoirs and systems for dispensing auxiliary oral care fluids before and/or during the tooth brushing regimen. An issue with existing fluid supply apparatuses and oral care implements containing the same is leakage, particularly due to air expansion as a result of temperature increases or pressure decreases which forces the liquid to leak out of the device. An improved fluid supply apparatus and personal/oral care implement containing the same is desired to address existing unwanted fluid leaks.

BRIEF SUMMARY

The present invention is directed to a fluid supply apparatus with leakage protection. The apparatus includes a housing defining a storage cavity having a total volume that includes a fluid occupying a portion of the total volume and a gas occupying the remainder of the total volume. The storage cavity extends along a cavity axis from a first end to a second end. A capillary member is fluidly coupled with the fluid. A plurality of vent apertures are formed into the housing, each forming a passageway between the storage cavity and an external atmosphere and each configured such that the fluid cannot flow through the vent apertures at ambient temperature and pressure equilibrium between the storage cavity and the external atmosphere. The vent apertures may be located and arranged on the housing such that irrespective of vertical and angular orientation of the housing relative to a gravitational vector at least one of the vent apertures is in spatial communication with the gas within the storage cavity.

In one aspect, the invention may be a fluid supply apparatus comprising: a housing defining a storage cavity having a total volume, the storage cavity extending along a cavity axis from a first end to a second end; a store of a fluid in the storage cavity and occupying a portion of the total volume, a remaining portion of the total volume occupied by a gas; a capillary member in fluid coupling with the store of the fluid, the capillary member extending through the housing; a plurality of vents apertures in the housing, each of the vent apertures forming a passageway between the storage cavity and an external atmosphere and configured such that the fluid cannot flow through the vent apertures at ambient temperature and pressure equilibrium between the storage cavity and the external atmosphere; and the vent apertures located and arranged on the housing such that irrespective of vertical and angular orientation of the housing relative to a gravitational vector at least one of the vent apertures is in spatial communication with the gas.

In another aspect, the invention may be a fluid supply apparatus comprising: a housing defining a storage cavity extending along a cavity axis from a first end to a second end; a capillary member in fluid coupling with the store of the fluid, the capillary member extending through the housing; a plurality of vents apertures in the housing, the vent apertures comprising: a plurality of first vent apertures in a sidewall of the housing and arranged in a spaced apart manner to circumferentially surround the cavity axis; at least one second vent aperture located adjacent the first end of the cavity; and at least one third vent aperture located adjacent the second end of the cavity.

The fluid supply apparatus may be located within a handle cavity of a handle of an oral care implement such that a gap is formed between an outer surface of the housing of the fluid supply apparatus and an inner surface of the handle of the oral care implement. The vent apertures of the fluid supply apparatus may be in spatial communication with the gap such that at least one handle vent aperture forms a passageway between the storage cavity and an external atmosphere.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
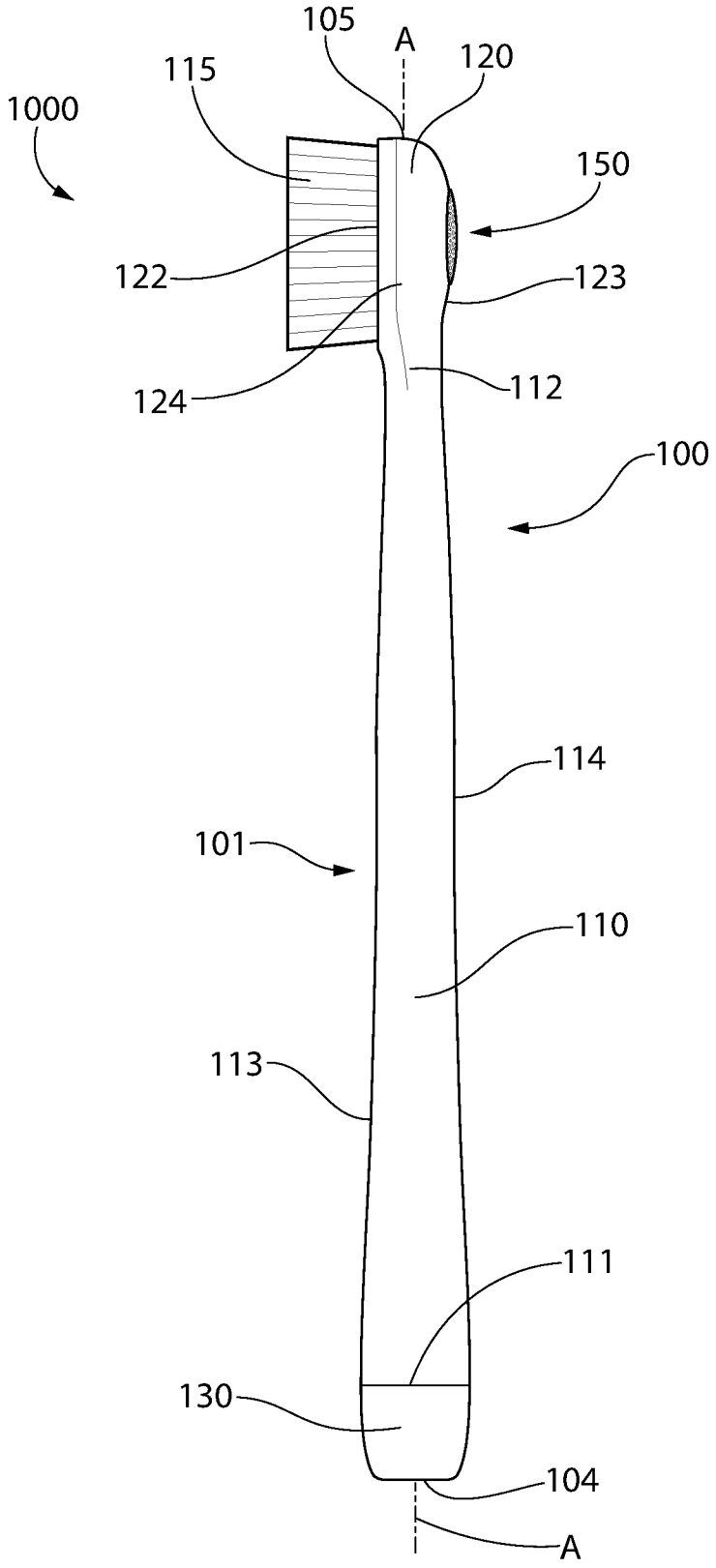
FIG. 1 is side view of a personal care implement in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring first to FIGS. 1-4, a fluid supply system 1000 is illustrated in accordance with an embodiment of the present invention. The fluid supply system 1000 generally comprises a personal care implement 100 and a fluid supply apparatus 200. In certain embodiments the fluid supply apparatus 200 is stored within a handle cavity 170 of a handle 120 of the personal care implement 100. The fluid supply apparatus 200 may include a housing 210 that defines a storage cavity 211 for storing a fluid. The fluid supply apparatus 200 also includes mechanisms for flowing the fluid from its stored location within the storage cavity 211 to another location at which the fluid is dispensed in a desired manner. In the exemplified embodiment, the fluid supply apparatus 200 permits flow of the fluid from the storage cavity 211 to an applicator 150 that is located on a rear surface 123 of a head 120 of the personal care implement 100, but the invention is not to be so limited in all embodiments. The fluid supply apparatus 200 is specifically configured to prevent fluid leakage regardless of the orientation at which the housing 210 is held under any normal usage and storage conditions including through changes in temperature and pressure. In some embodiments, the invention described herein relates to the fluid supply apparatus 200 by itself, and in other embodiments the invention relates to the entire system 1000 including the personal care implement 100 and the fluid supply apparatus 200 stored therein.

In the exemplified embodiment, the personal care implement 100 is an oral care implement, and more specifically a manual toothbrush. Thus, the invention will be described herein with the details predominately directed to a toothbrush. However, in certain other embodiments the personal care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Still further, the personal care implement 100 may not be one that is specifically used for oral care in all embodiments, but rather it may be an implement such as a deodorant application implement, a face or body cleaning implement, a make-up applicator implement, a razor or shaving implement, a hairbrush, or the like. Thus, it is to be understood that the inventive concepts discussed herein can be applied to any type of personal care implement unless a specific type of personal care implement is specified in the claims. Furthermore, in some embodiments the invention is directed solely to the fluid supply apparatus 200. Thus, the fluid supply apparatus 200 may be included in the personal care implement 100 or it may be a separate, stand-alone device. When a stand-alone device, the fluid supply apparatus 200 may include some type of applicator so that the fluid dispensed from the fluid supply apparatus 200 can be properly applied to a desired surface.

In the exemplified embodiment, the personal care implement 100 generally includes a body 101 comprising a handle 110 and a head 120 and an end cap 130 that is detachably coupled to the handle 110. The body 101 generally extends along a longitudinal axis A-A from a proximal end 104 to a distal end 105. Conceptually, the longitudinal axis A-A is a reference line that is generally coextensive with the three-dimensional center line of the body 101. Because the body 101 may, in certain embodiments, be a non-linear structure, the longitudinal axis A-A of the body 101 may also be non-linear in certain embodiments. However, the invention is not to be so limited in all embodiments and in certain other embodiments the body 101 may have a simple linear arrangement and thus a substantially linear longitudinal axis A-A.

The handle 110 extends from a proximal end 111 to a distal end 112 and the head 120 is coupled to the distal end 112 of the handle 110. In the exemplified embodiment, the end cap 130 is detachably coupled to the proximal end 111 of the handle 120. Specifically, the handle 120 has an opening 116 at the proximal end 111 thereof and the end cap 130 is coupled to the proximal end 111 of the handle 120 and closes the opening 116. The end cap 130 may be detachable from the handle 120 so that a fluid or oral care material can be stored within the body 101 and can be refilled by detaching the end cap 130 from the handle 110 to provide access, via the opening 116, to a cavity/reservoir within the body 101 within which the fluid may be stored. Furthermore, in certain embodiments the end cap 130 may be altogether omitted and the proximal end 111 of the body 101 may form a closed bottom end of the personal care implement 100. In such embodiments, refill of the reservoir may not be possible or may occur through other mechanisms/structures as would be understood to persons skilled in the art.

The handle 110 is an elongated structure that provides the mechanism by which the user can hold and manipulate the personal care implement 100 during use. The handle 110 comprises a front surface 113 and an opposing rear surface 114. In the exemplified embodiment, the handle 110 is generically depicted having various contours for user comfort. Of course, the invention is not to be so limited in all embodiments and in certain other embodiments the handle 110 can take on a wide variety of shapes, contours and configurations, none of which are limiting of the present invention unless so specified in the claims.

In the exemplified embodiment, the handle 110 is formed of a rigid plastic material, such as, for example without limitation, polymers and copolymers of ethylene, propylene, butadiene, vinyl compounds, and polyesters such as polyethylene terephthalate. Of course, the invention is not to be so limited in all embodiments and the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user.

The head 120 of the personal care implement 100 is coupled to the handle 110 and comprises a front surface 122, an opposing rear surface 123, and a peripheral surface 124 extending between the front and rear surfaces 122, 123. In the exemplified embodiment, the head 120 is formed integrally with the handle 110 as a single unitary structure using a molding, milling, machining or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In some embodiments the head 120 may be detachable from the handle 110. The head 120 may be formed of any one of the materials discussed above with regard to the handle 110.

In the exemplified embodiment, the head 120 of the personal care implement 100 is provided with a plurality of tooth cleaning elements 115 extending from the front surface 122. Of course, depending on the particular type of device selected for the personal care implement 100, the tooth cleaning elements 115 may be replaced with some other bristle-like elements (for example when the personal care implement 100 is a hairbrush or a mascara applicator) or may be altogether omitted. Furthermore, in the exemplified embodiment the tooth cleaning elements 115 are generically illustrated. In certain embodiments the exact structure, pattern, orientation and material of the tooth cleaning elements 115 are not to be limiting of the present invention. Thus, as used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Figure 2:
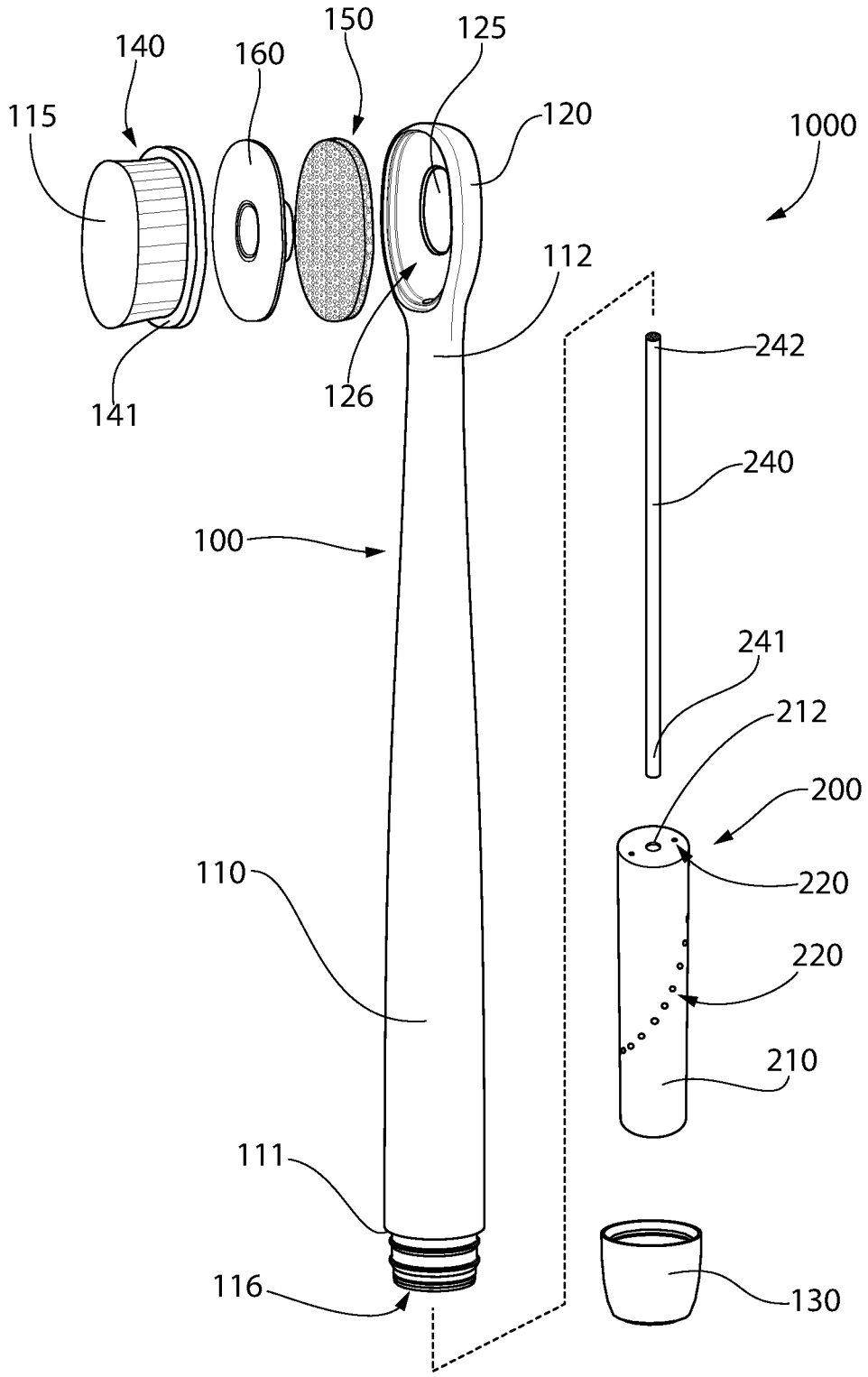
FIG. 2 is an exploded perspective view of the personal care implement of FIG. 1.
Figure 3:
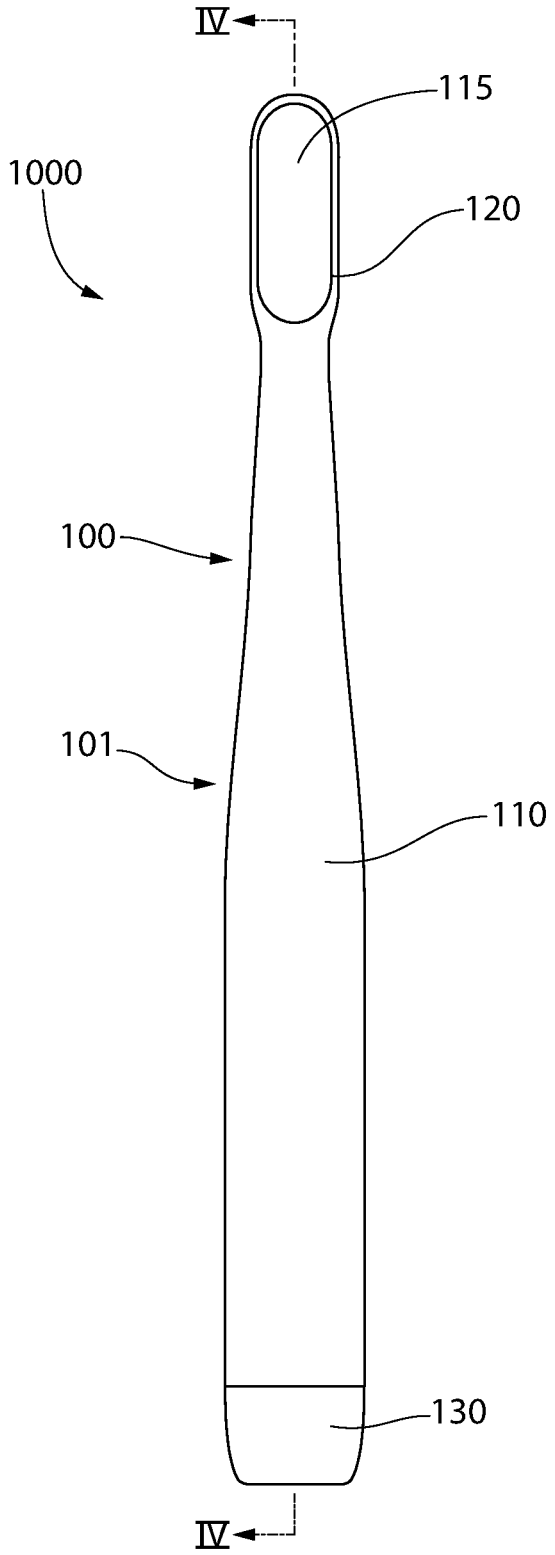
FIG. 3 is a front view of the personal care implement of FIG. 1.
Figure 4:
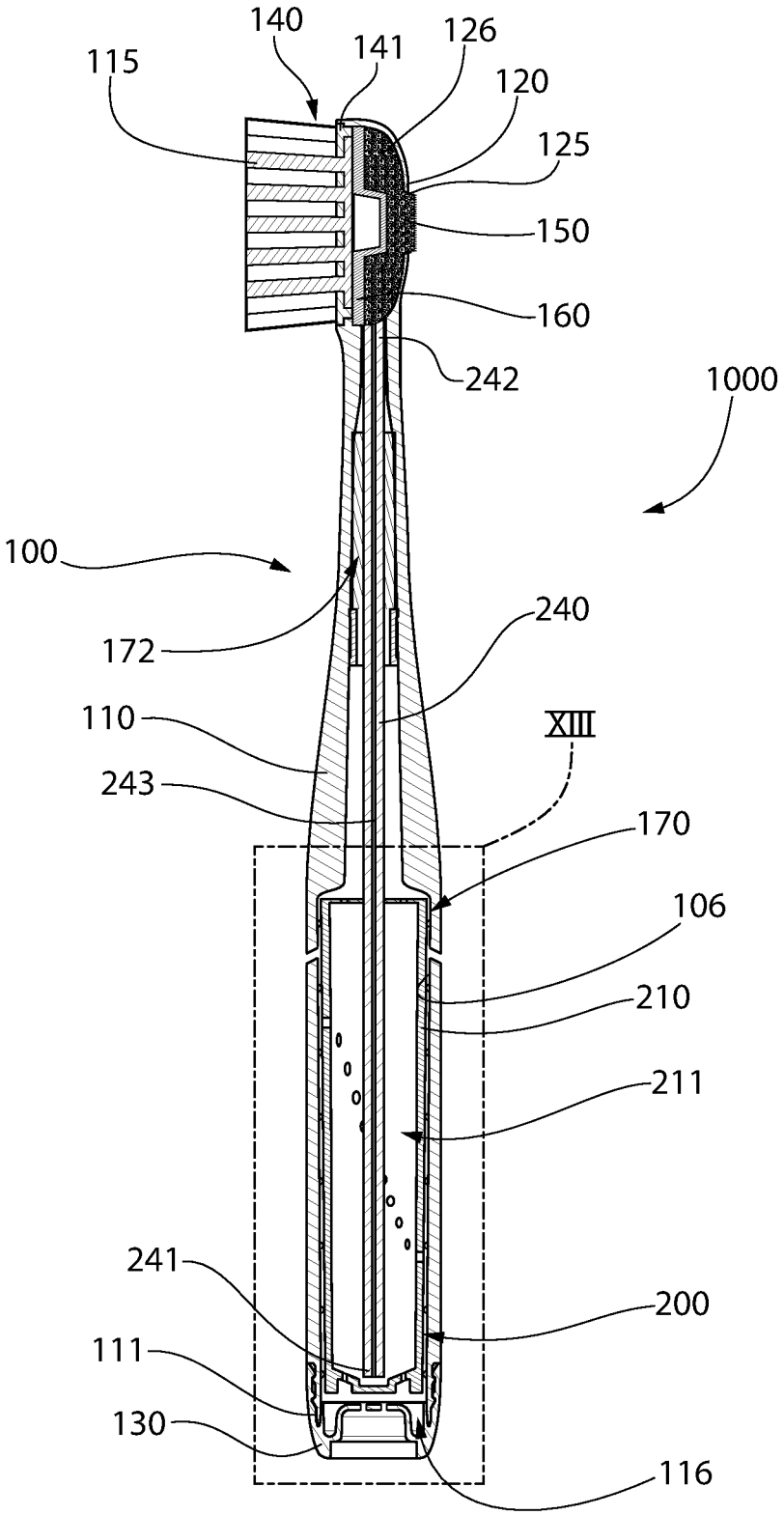
FIG. 4 is a cross-sectional view taken along line IV-IV of FIG. 3.
Figure 5:
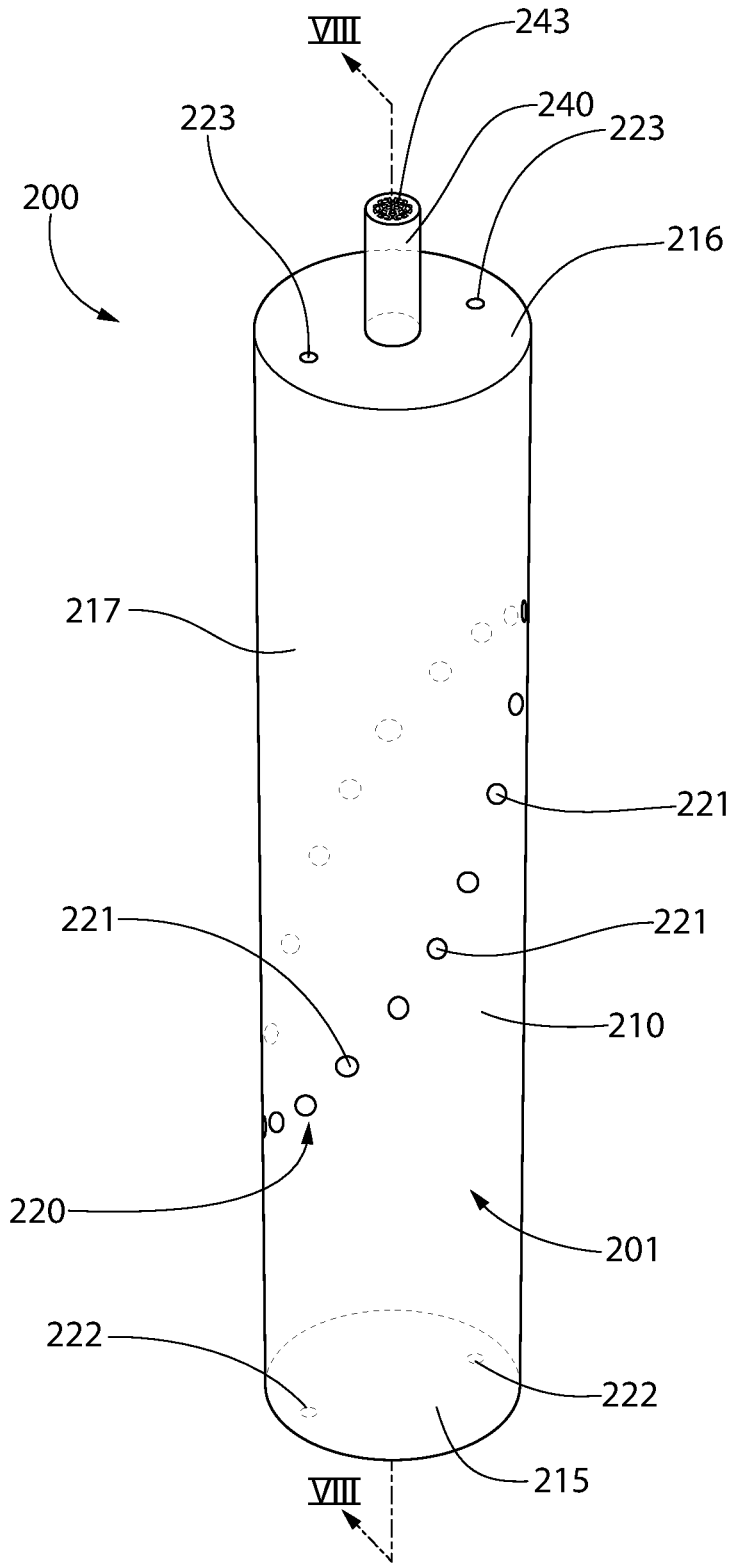
FIG. 5 is a perspective view of a fluid supply apparatus in accordance with an embodiment of the present invention.
Figure 6:
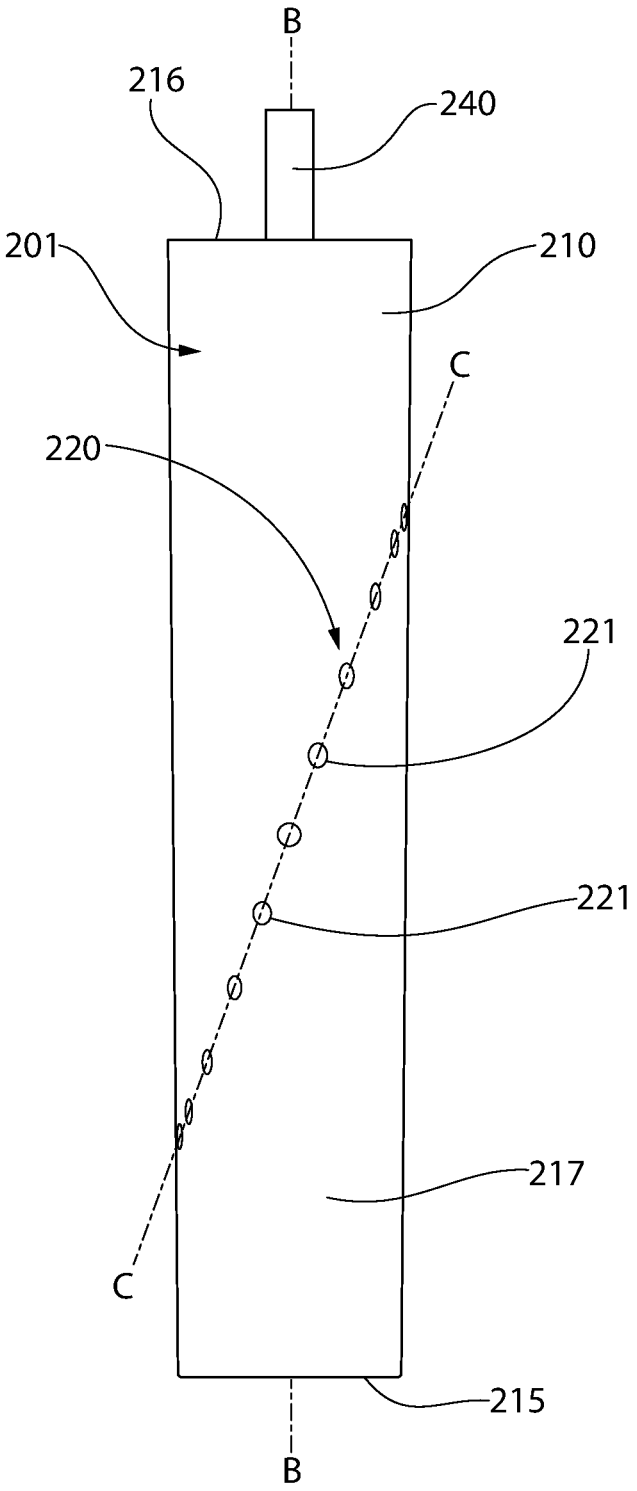
FIG. 6 is a front view of the fluid supply apparatus of FIG. 5.

Referring briefly to FIGS. 2 and 4, in the exemplified embodiment the tooth cleaning elements 115 are formed on a cleaning element assembly 140 that comprises a head plate 141 and the tooth cleaning elements 115 mounted thereon. In such an embodiment, the head plate 141 is a separate and distinct component from the body 101 of the personal care implement 100. However, the head plate 141 is connected to the body 101 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 141 and the body 101 are separately formed components that are secured together during manufacture of the personal care implement 100. More specifically, the tooth cleaning elements 115 are secured to the head plate 141 in a manner known in the art (i.e., anchor free tufting or AFT) to form the cleaning element assembly 140, and then the cleaning element assembly 140 is coupled to the head 120. Alternatively, the tooth cleaning elements 115 may be connected to the head 120 using AMR techniques, stapling, or the like. The invention is not to be particularly limited by the manner in which the tooth cleaning elements 115 are coupled to the head 120 in all embodiments.

Although not illustrated herein, in certain embodiments the head 120 may also include a soft tissue cleanser coupled to or positioned on its rear surface 123. An example of a suitable soft tissue cleanser that may be used with the present invention and positioned on the rear surface 123 of the head 120 is disclosed in U.S. Pat. No. 7,143,462, issued Dec. 5, 2006 to the assignee of the present application, the entirety of which is hereby incorporated herein by reference. In certain other embodiments, the soft tissue cleanser may include protuberances, which can take the form of elongated ridges, nubs, or combinations thereof. Of course, the invention is not to be so limited and in certain embodiments the personal care implement 100 may not include any soft tissue cleanser.

Referring back to FIGS. 1-4 concurrently, in the exemplified embodiment the personal care implement 100 comprises an applicator 150 protruding from the rear surface 123 of the head 120. More specifically, the head 120 has an opening 125 that extends from the rear surface 123 of the head 120 into a basin cavity 126 of the head 120. The applicator 150 is inserted into the basin cavity 126 of the head 120 and extends through the opening 125 and protrudes from the rear surface 123 of the head 120. Thus, during use of the personal care implement 100 to brush teeth, the applicator 150 will engage/contact the user's oral surfaces and dispense a fluid thereon as discussed in more detail below. The personal care implement 100 may also include a divider member 160 that divides the basin cavity 126 into an upper chamber and a lower chamber such that the cleaning element assembly 140 is located in the upper chamber and the applicator 150 is located in the lower chamber. The divider member 160 may seal the applicator 150 within the lower chamber so that any fluid loaded on the applicator 150 does not pass into the upper chamber.

The applicator 150 may be formed of a capillary material that is capable of being loaded with a fluid that can then be dispensed when the applicator 150 is compressed. For example, the applicator 150 may be a porous foam such as including without limitation a polyurethane foam or other open cell porous material. Thus, in the exemplified embodiment the applicator 150 can be formed of any type of material through which a liquid can travel via capillary action or capillary flow. Specifically, the capillary material can be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. Furthermore, although described herein as being formed of a capillary material, the invention is not to be so limited in all embodiments and some alternative embodiments will be described herein below. For example, in certain embodiments the applicator 150 may be formed of a plastic material or a rubber material and may have an orifice formed therethrough to enable the fluid to flow through the applicator for application to a biological surface such as a user's oral cavity, facial surfaces, or the like.

The handle 110 of the personal care implement 100 comprises an inner surface 106 that defines a handle cavity 170. The handle cavity 170 is closed at its bottom end via the end cap 130 that closes the opening 116 at the proximal end 111 of the handle 110. The handle cavity 170 is open at its top end so as to be spatially coupled to the opening 125. More specifically, the handle cavity 170 is spatially coupled to the opening 125 in the head 120 via a passageway 172 that extends through the neck region of the personal care implement 100.

The fluid supply apparatus 200 generally comprises a housing 210 defining a storage cavity 211 and a capillary member 240. The storage cavity 211 is designed to hold a store of a fluid as discussed in greater detail below with reference to FIGS. 14A-14D. The capillary member 240 is at least partially located within the storage cavity 211 so that the capillary member 240 is fluidly coupled to the store of the fluid that is located within the storage cavity 211. The housing 210 has an opening 212 in its top end through which the capillary member 240 passes so that a portion of the capillary member 240 extends external to the housing 210. More specifically, the capillary member 240 extends from the housing 210 and through the passageway 172 in the neck region of the personal care implement 100 to the applicator 150 so that the capillary member 240 can draw fluid from the store of the fluid in the storage cavity 211 and transport that fluid to the applicator 150 where it can be dispensed at an appropriate time and location. The housing 210 also comprises a plurality of vent apertures 220 that facilitate venting of the storage cavity 211 to prevent fluid leaks as discussed in much greater detail below. The vent apertures 220 create an air intake/venting system that allows air to replace the fluid that is dispensed from the storage cavity 211 over time during use and allows air to exit the storage cavity 211 to prevent it from exerting pressure on any fluid in the storage cavity 211.

Turning now to FIGS. 2 and 4, the relationship between the personal care implement 100 and the fluid supply apparatus 200 will be described in more detail. The housing 210 of the fluid supply apparatus 200 is positioned within the handle cavity 170. Although the housing 210 is illustrated as being wholly encased within the handle cavity 170, the invention is not to be so limited in all embodiments and the housing 210 may extend into the passageway 172 or it may even protrude from the proximal end 111 of the handle 110 in some alternative embodiments. However, fully enclosing the housing 210 within the handle cavity 170 provides a more desirable aesthetic as the overall appearance of the personal care implement 100 can be more similar to that of a traditional device of the same type. The capillary member 240 extends from a first end 241 that is located within the storage cavity 211 and fluidly coupled to the fluid stored in the storage cavity 211 to a second end 242 that is fluidly coupled to the applicator 150. Thus, the capillary member 240 transports the fluid from the storage cavity 211 of the housing 210 to the applicator 150 as described herein.

Figure 7:
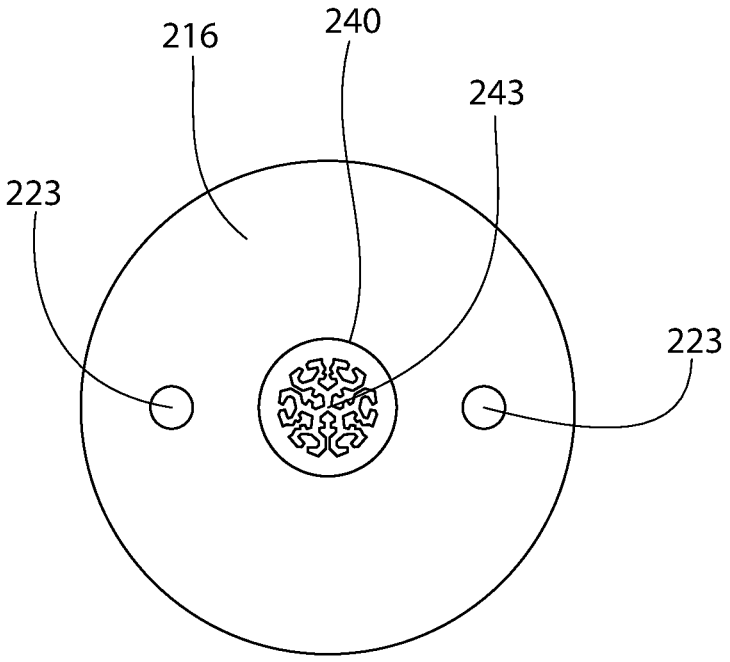
FIG. 7 is a top view of the fluid supply apparatus of FIG. 5.
Figure 8:
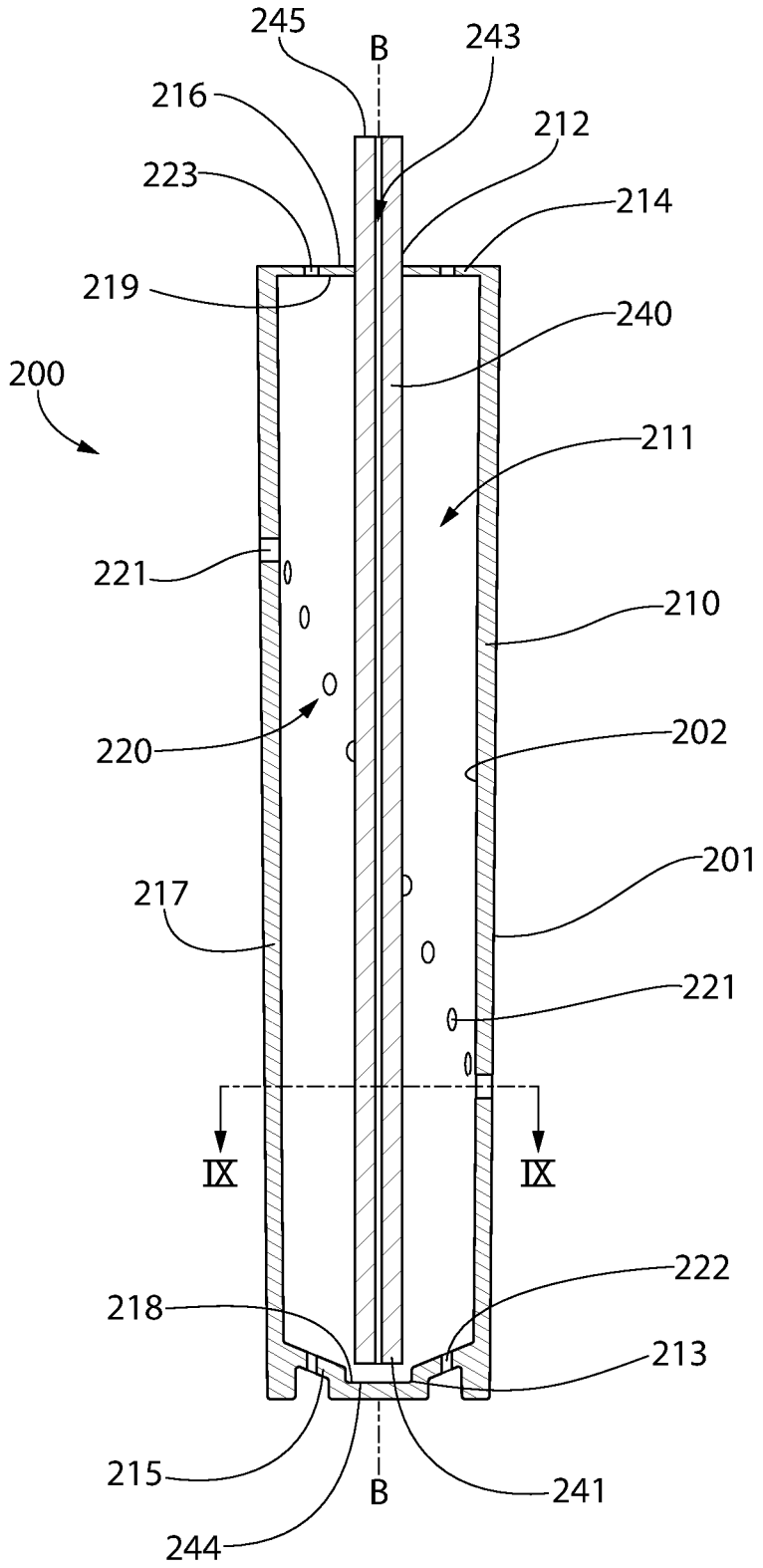
FIG. 8 is a cross-sectional view taken along line VIII-VIII of FIG. 5.
Figure 9:
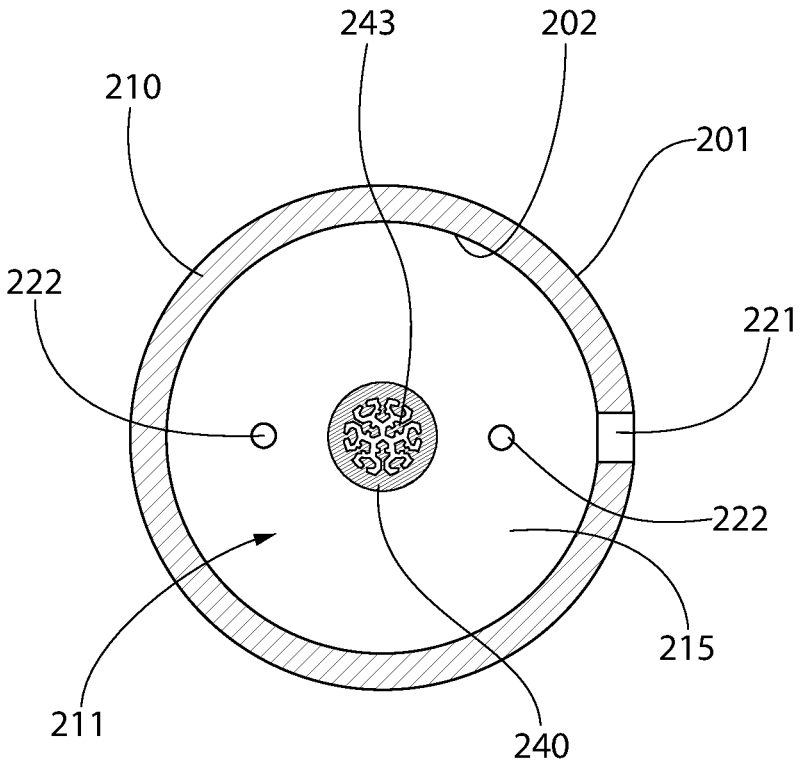
FIG. 9 is a cross-sectional view taken along line IX-IX of FIG. 8.

In the exemplified embodiment, the capillary member 240 is a capillary tube having a capillary passageway 243 extending entirely through the capillary member 240 from the first end 241 to the second end 242 that permits the fluid to flow within the capillary member 240 from the first end 241 to the second end 242 via a wicking action. Thus, in this manner the fluid is able to flow from its storage location within the storage cavity 211 of the housing 210 to the applicator 150 so that the applicator 150 can be loaded with the fluid. Specifically, the passageway 243 may have a cross-sectional size and shape that permits flow of the fluid all the way from the storage cavity 211 to the applicator 150 to ensure that the applicator 150 remains loaded with the fluid (see, e.g., FIG. 7). In other embodiments, the capillary member 240 may be formed of a porous material, such as any of the materials described above with reference to the applicator 150. In such embodiments the fluid may flow up the capillary member 240 via a wicking action (also referred to herein as capillary action) due to the material of the capillary member 240. In either embodiment, the flow of the fluid occurs naturally via capillary action without the need for a separate pump.

In certain embodiments, the capillary member 240 has a capillary structure which may be formed in numerous configurations and from numerous materials operable to produce fluid flow via capillary action. In one non-limiting embodiment, the capillary member 240 may be configured as a tube or lumen having an internal open capillary passageway extending between ends of the capillary member which is configured and dimensioned in cross section to produce capillary flow. The lumen or open capillary passageway may have any suitable cross sectional shape and configuration. In such embodiments the capillary member 240 may be formed of a porous material as described below or a non-porous material (e.g., plastics such as polypropylene, metal, rubber, or the like). In other non-limiting embodiments, capillary member 240 may be formed of a porous and/or fibrous material of any suitable type through which a fluid can travel via capillary action or flow. Examples of suitable materials include without limitation fibrous felt materials, ceramics, and porous plastics with open cells (e.g. polyurethane, polyester, polypropylene, or combinations thereof) including such materials as those available from Porex Technologies, Atlanta, Ga. The capillary member material may therefore be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. A mixture of porous and/or fibrous materials may be provided which have a distribution of larger and smaller capillaries. The capillary member 240 can be formed from a number of small capillaries that are connected to one another, or as a larger single capillary rod. The capillary member whether formed as a lumen or of porous or fibrous materials may have any suitable polygonal or non-polygonal cross sectional shape including for example without limitation circular, elliptical, square, triangular, hexagonal, star-shaped, etc. The invention is not limited by the construction, material, or shape of the capillary member.

Referring to FIGS. 5-9 concurrently, the fluid supply apparatus 200 will be described in greater detail. The housing 210 of the fluid supply apparatus 200 has an outer surface 201 and an opposite inner surface 202. The inner surface 202 of the housing 210 defines the storage cavity 211 that is configured to store the fluid therein. The storage cavity 211 extends from a first end 213 to a second end 214 along a cavity axis B-B. More specifically, the housing 210 comprises a first end wall 215 that bounds the first end 213 of the storage cavity 211 and a second end wall 216 that bounds the second end 214 of the storage cavity 211. Furthermore, the housing 210 comprises a sidewall 217 extending between the first and second end walls 215, 216. In the exemplified embodiment, the housing 210 has a round or circular cross-sectional shape, but it may have other shapes in other embodiments (i.e., square, triangular, hexagonal, etc.) and the invention is not to be limited by the exemplified shape in all embodiments. In certain embodiments the shape of the housing 210 may be dictated by the shape of the handle cavity 170.

The storage cavity 211 has a floor 218 formed by the first end wall 215 of the housing 210 and a roof 219 formed by the second end wall 216 of the housing 210. The terms "floor" and "roof" could be interchangeable depending on the orientation of the housing 210 at any given time. Specifically, the terms "floor" and "roof" are merely intended to denote the lower and upper boundaries of the storage cavity 211. The remaining boundary of the storage cavity 211 is formed by the inner surface 202 of the housing 210 along the entirety of the sidewall 217. The capillary member 240 is partially located within the storage cavity 211 and extends from a location adjacent to the floor 218 through the entire length of the storage cavity 211 and through the opening 212 that is formed into the second end wall 216 of the housing 210. In the exemplified embodiment, the capillary member 240 has openings into the passageway 243 at the lower-most end 244 thereof and at the upper-most end 245 thereof. Thus, the fluid within the storage cavity 211 can only enter into the passageway 243 of the capillary member 240 through the opening in the lower-most end 244 of the capillary member 240. There are no other openings along the length of the capillary member 240 that permit the fluid to enter into the passageway 243 of the capillary member 240. As a result, in the exemplified embodiment fluid can only enter into the passageway 243 of the capillary member 240 when the fluid is in contact with the lower-most end 244 of the capillary member 240. Thus, in certain orientations of the housing 210 and certain fluid levels within the storage cavity 211, the fluid is unable to enter into the passageway 243 of the capillary member 240 because it is not in contact with the opening in the lower-most end 244 of the capillary member 240. Of course, in other embodiments additional openings into the passageway 243 of the capillary member 250 may be provided.

The fluid supply apparatus 200 requires an air intake and venting system to allow air to replace the fluid that is dispensed from the storage cavity 211 over time during use. This helps to ensure consistent flow of the fluid during use but must be designed correctly to ensure that uncontrolled fluid leakage is prevented regardless of the orientation at which the housing 210 is positioned and regardless of changes in temperature and pressure. As mentioned briefly above, in the exemplified embodiment the fluid supply apparatus 200 comprises the plurality of vent apertures 220 in the housing 210 that operate as the air intake and venting system of the device. More specifically, each of the vent apertures 220 forms a passageway from the storage cavity 211 to the external atmosphere (i.e., the atmosphere external to the storage cavity 211). Thus, each of the vent apertures 220 extends entirely through the housing 210 from the inner surface 202 thereof to the outer surface 201 thereof.

In certain embodiments, each of the vent apertures 220 is designed with a specific dimension/size tailored to the physical properties (e.g., viscosity and surface tension) of the fluid stored within the storage cavity 211 such that once system equilibrium is reached, the fluid cannot pass through the vent apertures 220 under normal usage conditions. Stated another way, each of the vent apertures 220 is configured such that a fluid within the storage cavity 211 cannot flow through the vent apertures 220 at ambient temperature and with a pressure equilibrium existing between the storage cavity and the external atmosphere. However, at the same time the vent apertures 220 are designed to permit gas, such as air, within the storage cavity 211 to pass through the vent apertures 220. Specifically, as long as the vent apertures 220 are not clogged, the gas/air will be capable of freely passing through the vent apertures 220 both into and out of the storage cavity 211 as needed to provide proper air intake and venting to ensure proper operation of the device (i.e., consistent fluid flow during use) without leakage. In certain embodiments, the vent apertures 220 may have a diameter in a range of 0.05 mm to 0.5 mm, and more specifically between 0.1 mm and 0.3 mm.

As discussed in greater detail below with reference to FIGS. 14A-14D, the vent apertures 220 are positioned along the housing 210 in such a manner that there are no pockets of trapped air within the storage cavity 211, regardless of orientation of the housing 210, that can expand due to increases in temperature or decreases in pressure (both of which would exert pressure on the fluid in the storage cavity 211 and cause it to be expelled in an uncontrolled manner). Rather, any air pockets are always spatially coupled to the exterior atmosphere so that as a result of any increases in temperature or decreases in pressure the air/gas in the air pockets will exit the storage cavity 211 rather than exert pressure on the fluid and cause it to leak out of the storage cavity 211. In order to achieve this, at least one of the vent openings 220 is positioned along the housing 210 at a location that is aligned with a maximum internal diameter of the storage cavity 211.

In the exemplified embodiment, the plurality of vent apertures 220 comprise a plurality of first vent apertures 221 formed into the sidewall 217 of the housing 210, at least one second vent aperture 222 located adjacent the first end 213 of the storage cavity 211, and at least one third vent aperture 223 located adjacent the second end 214 of the storage cavity 211. In the exemplified embodiment, the second vent aperture 222 is formed into the first end wall 215 of the housing 210 and the third vent aperture 223 is formed into the second end wall 216 of the housing 210. Furthermore, in the exemplified embodiment there are two of the second vent apertures 222 and two of the third vent apertures 223, although a single one of the second and third vent apertures 222, 223 or more than two of the second and third vent apertures 222, 223 could be used in other embodiments.

The second vent apertures 222 permit proper venting of the storage cavity 211 when the housing 210 is in an upright orientation and the plurality of first vent apertures 221 and the third vent apertures 223 are covered by the fluid in the storage cavity 211. The third vent apertures 223 permit proper venting of the storage cavity 211 when the housing 211 is in an inverted orientation and the plurality of first vent apertures 221 and the second vent apertures 222 are covered by the fluid in the storage cavity 211. The plurality of first vent apertures 221 permit proper venting of the storage cavity 211 when the second and third vent apertures 222, 223 are covered by the fluid in the storage cavity 211 but at least one of the plurality of first vent apertures 221 remains outside of the fluid in the storage cavity 211. In every instance that the second and third vent apertures 222, 223 are covered by the fluid in the storage cavity 211, regardless of the specific orientation of the housing 210, at least one of the first vent apertures 221 will be located outside of the fluid so that it is spatially coupled to the gas within the storage cavity 211. Thus, regardless of the orientation of the housing 210, there is always one vent aperture 221, 222, 223 available for venting the storage cavity 211 which assists in preventing fluid leaks. This will be described in greater detail below with specific reference to FIGS. 14A-14D.

In the exemplified embodiment, the plurality of first vent apertures 221 are located in a middle portion of the housing 210 between the first and second end walls 215, 216. Although in the exemplified embodiment the plurality of first vent apertures 221 do not extend all the way to the first and second end walls 215, 216, in other embodiments they could. The plurality of first vent apertures 221 are arranged in a spaced apart manner along the sidewall 217. In the exemplified embodiment, the first vent apertures 221 are both axially and angularly equi-spaced from one another. More specifically, in the exemplified embodiment adjacent ones of the first vent apertures 221 are separated by an angle that is less than or equal to 60 degrees, more specifically less than or equal to 50 degrees, more specifically less than or equal to 40 degrees, more specifically less than or equal to 30 degrees, more specifically less than or equal to 20 degrees, and more specifically less than or equal to 10 degrees. However, the first vent apertures 221 need not be equi-spaced in all embodiments and adjacent first vent apertures 221 may have variations in spacing in alternative embodiments (i.e., a first of the first vent aperture 221 that is adjacent to a second and a third of the first vent apertures 221 may be in closer to proximity the second of the first vent apertures 221 than to the third of the first vent apertures 221).

In the exemplified embodiment, the first vent apertures 221 circumferentially surround the cavity axis B-B of the storage cavity 211 of the housing 210. Thus, the first vent apertures 221 collectively define a reference ring (if a reference line were added to connect each of the first vent apertures 221 to those adjacent to it a ring would be created) that circumferentially surrounds the cavity axis B-B. This reference ring is oblique to the cavity axis B-B. State another way, in the exemplified embodiment the plurality of first vent apertures 221 lie in a reference plane C-C that is oblique to the cavity axis B-B. However, the invention is not to be so limited in all embodiments and an alternative arrangement will be described with reference to FIGS. 10 and 11 with other alternative arrangements not illustrated herein also being possible and within the scope of the present invention.

Figure 10:
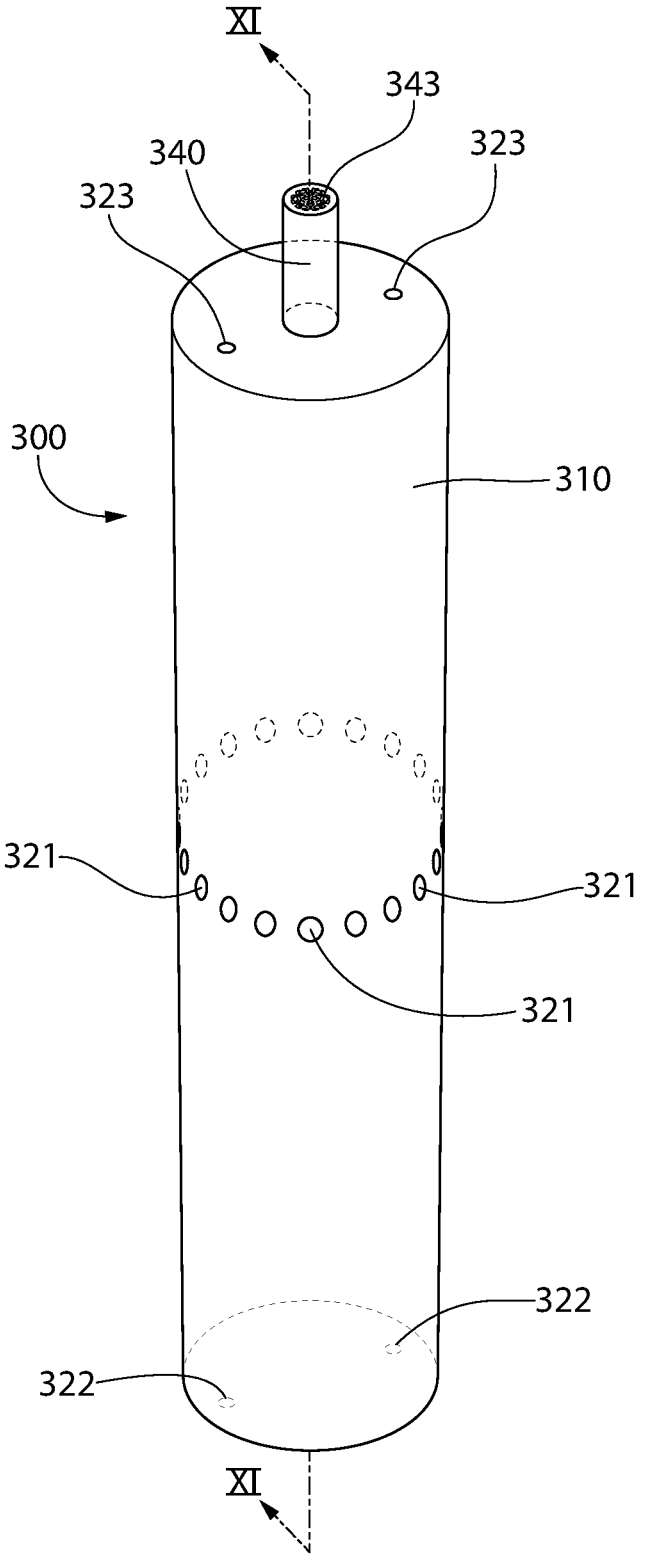
FIG. 10 is a perspective view of a fluid supply apparatus in accordance with an alternative embodiment of the present invention.
Figure 11:
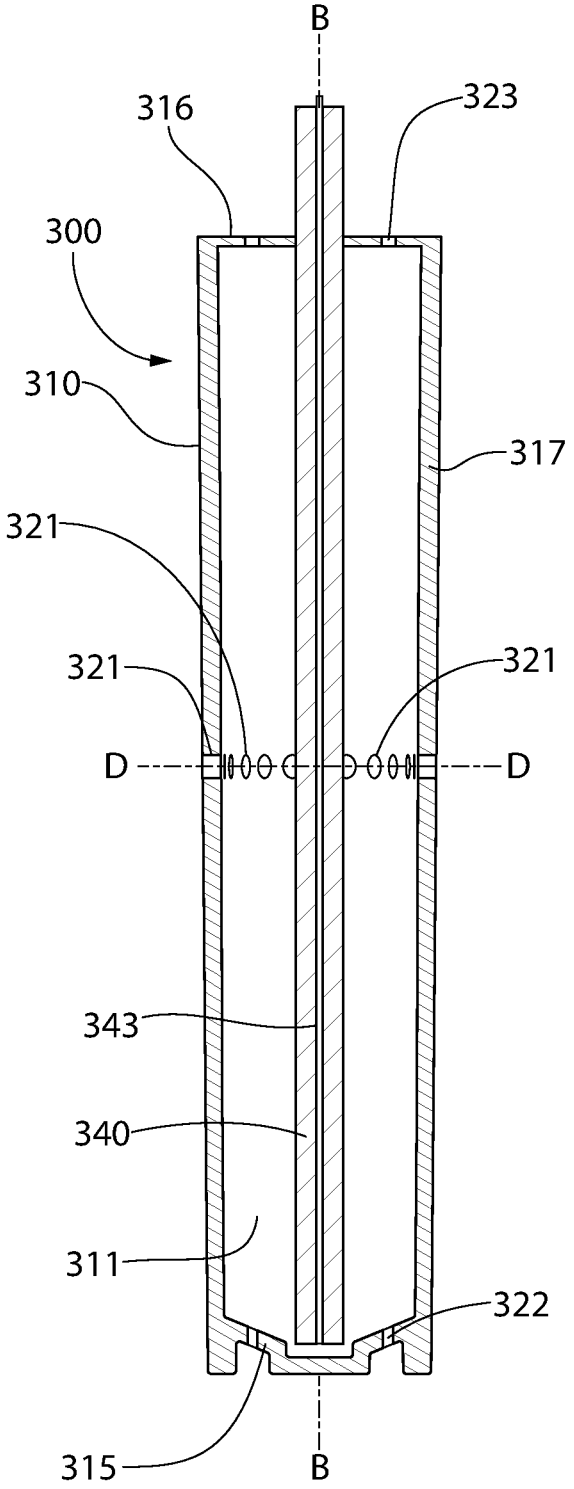
FIG. 11 is a cross-sectional view taken along line XI-XI of FIG. 10.

Referring to FIGS. 10 and 11, an alternative fluid supply apparatus 300 is illustrated in accordance with an embodiment of the present invention. Similar reference numerals will be used to describe the features of the fluid supply apparatus 300 as were used to describe the features of the fluid supply apparatus 200 except the 300-series of numbers will be used. Certain reference numerals are illustrated in FIGS. 10 and 11 and not specifically described herein, it being understood that the description of the similar feature with reference to the fluid supply apparatus 200 is applicable.

The fluid supply apparatus 300 is identical to the fluid supply apparatus 200 except with regard to the location of the first vent apertures 321. Specifically, in this embodiment the first vent apertures 321 are located centrally along the length of the housing 310 between the first and second end walls 315, 316 such that they lie in a reference plane D-D that is orthogonal to the cavity axis B-B. Of course, the first vent apertures 321 could be located closer to the first end wall 315 or closer to the second end wall 316 of the housing 310 in other embodiments while still lying in a reference plane D-D that is orthogonal to the cavity axis B-B. In this embodiment, the first vent apertures 321 still circumferentially surround the cavity axis B-B in a spaced apart manner, but they are all located at the same axial height along the length of the housing 310. In any of the embodiments described herein, there could be multiple loops/rings of the first vent apertures 221, 321. In still other embodiments, the first vent apertures 321 could be arranged in a helical pattern about the cavity axis B-B.

Figure 12:
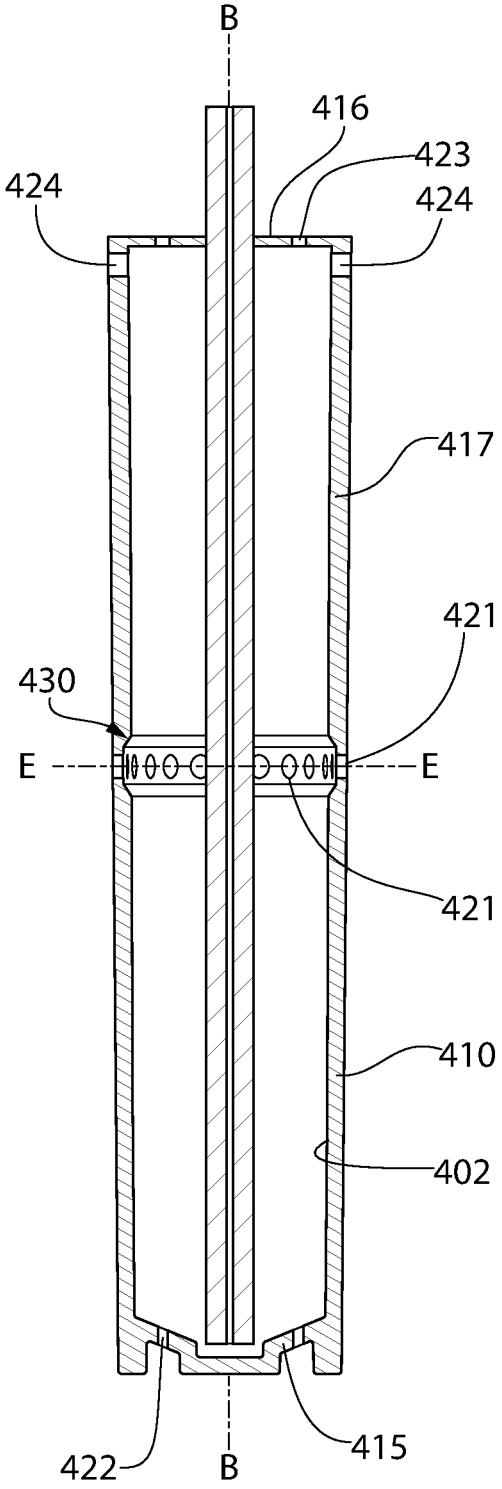
FIG. 12 is a cross-sectional view taken along line XI-XI of FIG. 10 in accordance with an alternative embodiment of the present invention.

Referring briefly to FIG. 12, another alternative fluid supply apparatus 400 is illustrated in accordance with an embodiment of the present invention. Similar reference numerals will be used to describe the features of the fluid supply apparatus 400 as were used to describe the features of the fluid supply apparatus 200 except the 400-series of numbers will be used. Certain reference numerals are illustrated in FIG. 12 and not specifically described herein, it being understood that the description of the similar feature with reference to the fluid supply apparatus 200 is applicable.

In this embodiment, the first vent apertures 321 still lie in a reference plane E-E that is orthogonal to the cavity axis B-B just like with the fluid supply apparatus 300. However, in this embodiment the storage cavity 411 has a region 430 with an increased diameter or transverse cross-sectional area. Specifically, within the region 430 of the storage cavity 411, the inner surface 402 of the housing 410 and more specifically of the sidewall 417 is located radially furthest from the cavity axis B-B. Thus, a distance measured from the cavity axis B-B to the inner surface 402 of the housing 410 is greater at the region 430 than at other locations along the storage cavity 411. In this embodiment, the first vent apertures 421 are located within the region 430. Thus, the first vent apertures 421 are formed into the housing 410 along the portion of the inner surface 402 of the housing 410 that is located furthest from the cavity axis B-B. Stated another way, the first vent apertures 421 are located along the portion of the storage cavity 411 that has a maximum internal diameter. Locating the first vent apertures 421 in this manner ensures that the first vent apertures 421 will be located within air pockets in the storage cavity 411 regardless of the orientation at which the housing 410 is positioned as discussed in more detail below with reference to FIGS. 14A-14D.

In this embodiment, the housing 410 also includes additional vent apertures 423, 424 formed into the sidewall 417 adjacent to the second end wall 416. Furthermore, still more vent apertures could be included in the sidewall 417 to further ensure that at any orientation of the housing 410, at least one of the vent openings will be located within the air/gas in the storage cavity 411 and outside of any fluid within the storage cavity 411. These additional vent apertures 423, 424 (and any others not illustrated) can be used with any of the embodiments described herein.

In still other embodiments, the arrangement of the first vent apertures 221 can be random or the first vent apertures 221 could be arranged along the entirety of the housing 210 in a spaced apart manner. In one embodiment the first vent apertures 221 should be arranged around the entire circumference of the housing 210 to surround the cavity axis B-B, but these first vent apertures 221 can be spaced apart, located at different axial locations along the housing 210, or the like. So long as the functionality described herein is achieved so that one of the vent apertures 221, 222, 223 is in spatial communication with the air/gas within the storage cavity 211 regardless of the orientation of the storage cavity 211, the exact locations of the plurality of first vent apertures 221 is not to be limiting of the present invention.

Figure 13:
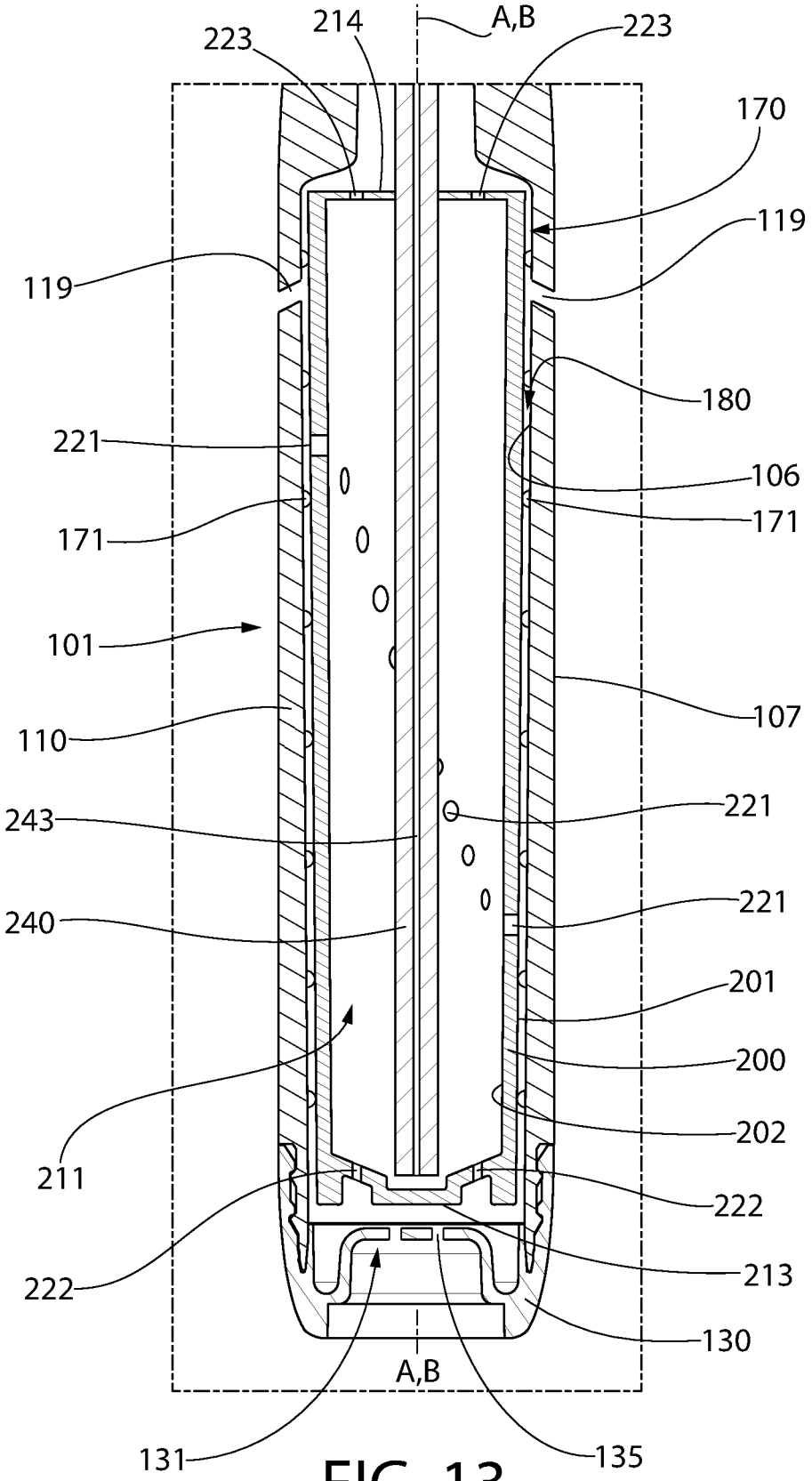
FIG. 13 is a close-up view of area XIII of FIG. 4.

Referring to FIG. 13, a close-up view of a portion of FIG. 4 is provided to illustrate the fluid supply apparatus 200 within the handle cavity 170 of the personal care implement 100. In the exemplified embodiment, a protuberance 171 (either ring-like or a plurality of spaced apart protuberances arranged in a ring) extends from the inner surface 106 of the handle 110 into the handle cavity 170. The protuberance 171 abuts against the outer surface 201 of the housing 210 to secure the housing 210 properly in position within the handle cavity 170. Thus, the protuberance 171 may ensure that the housing 210 is secured in place within the handle cavity 170 via an interference or friction fit. The protuberance 171 may be formed of resilient elastomeric material so that the protuberance 171 will compress as the housing 210 is inserted into the handle cavity 170 and exert pressure on the outer surface 201 of the housing 210 to secure it in place. In the exemplified embodiment, there are a plurality of protuberances 171 arranged along the length of the storage cavity 211 (each of which may represent a single protuberance in any shape including ring-like or a plurality of spaced-apart protuberances arranged in a ring). The housing 210 may also include a detent or other recess in its outer surface 201 that mates with the protuberance 171 to further secure the housing 210 in place. Other mechanical structures can be used to secure the housing 210 within the handle cavity 170 in other embodiments.

When the housing 210 is located within the handle cavity 170, the outer surface 201 of the housing 210 is spaced apart from the inner surface 106 of the handle 110 so that a gap 180 exists therebetween. In certain embodiments, the gap 180 is an annular gap that circumferentially surrounds the housing 210 along the entire length of the housing 210 between the first and second ends 213, 214 thereof. The gap 180 may be a continuous gap in some embodiments or it may be segmented or partially segmented in others as long as each segment is vented to the external atmosphere as described herein.

In that regard, the body 101, and more specifically the handle 110 in the exemplified embodiment, has at least one vent opening 119 extending from the inner surface 106 of the handle 110 to an outer surface 107 of the handle 110. Where the gap 180 is segmented, there should be at least one vent opening 119 formed into the handle 110 within each segment of the gap 180. The at least one vent opening 119 forms a passageway from the gap 180 to the exterior atmosphere. In the exemplified embodiment the vent opening 119 is oriented oblique to the longitudinal axis A-A of the personal care implement 100. This may be desirable to limit blockage of the vent opening 119 by preventing debris from entering into the vent opening 119. Of course, the invention is not to be so limited in all embodiments and in other embodiments the vent opening 119 may be orthogonal to the longitudinal axis A-A of the personal care implement 100 and/or to the cavity axis B-B of the storage cavity 210.

Moreover, in the exemplified embodiment the cap 130 also includes at least one vent opening 135 that provides a passageway from the gap 180 to the exterior atmosphere. In this embodiment, the cap 130 includes a recessed portion 131 such that if the personal care implement 100 were positioned vertically with the cap 130 resting on a horizontal surface, the recessed portion 131 of the cap 130 would be spaced from the horizontal surface. This maintains the vent opening 135 in the cap 130 spaced from such a horizontal surface, which may facilitate preventing debris from entering into and clogging the vent opening 135.

Although the exemplified embodiment illustrates the vent openings 119 in the handle 110 and the vent openings 135 in the cap 130, in alternative embodiments only one of the vent opening 119 in the handle 110 and the vent opening 135 in the cap 130 may be needed to achieve the desired venting as described herein. However, at least one vent from the gap 180 to the exterior atmosphere is needed to permit and facilitate air to flow from the storage cavity 211 to the exterior atmosphere during periods of air expansion to prevent fluid leakage.

Thus, in the exemplified embodiment, a passageway exists from the storage cavity 211 to the external atmosphere as follows: from the storage cavity 211 through one of the first, second, and third vent openings 221, 222, 223 and into the gap 180, and then from the gap 180 to the external atmosphere through one of the vent openings 119, 135. Thus, as long as at least one of the first, second, and third vent openings 221, 222, 223 is located in spatial contact with air/gas within the storage cavity 211 (as opposed to being in spatial contact with fluid in the storage cavity 211), the storage cavity 211 is properly vented to substantially prevent fluid leaks as has been described herein.

Although in the exemplified embodiment the fluid supply apparatus 200 and the housing 210 are separate components from the personal care implement 100, in other embodiments the features of the housing 210 may be wholly incorporated directly into the personal care implement 100. For example, in one embodiment the inner surface 106 of the handle 110 may define the storage cavity for retaining the fluid that is intended to be dispensed via the applicator 150. In such embodiment the handle 110 may include an internal feature to operate as the roof or upper bounds of the storage cavity. In such embodiment, the vent openings 221, 222, 223 may be formed directly into the handle 110 of the personal care implement 100 in the manner described herein above with regard to the housing 210, 310, 410. Thus, in such an embodiment the handle 110 can operate exactly in the same manner as the housing 210 thus negating the need for the housing 210 altogether.

Referring now to FIGS. 14A-14D, operation of the fluid supply apparatus 200 within the personal care implement 100 will be described. It should be appreciated that the fluid supply apparatus 200 would operate in a similar manner on its own without being disposed within the personal care implement 100. Thus, in certain embodiments the fluid supply apparatus 200 may be coupled to an applicator, but not one that is a part of a personal care implement 100. For example, the second end 242 of the capillary member 240 may be coupled to an applicator that can be used to apply a fluid to a desired surface.

Specifically, as will be better understood from the description of FIGS. 14A-14D that follows, the vent apertures 221, 222, 223 are located and arranged on the housing 210 such that irrespective of the vertical and angular orientation of the housing 210 relative to a gravitational vector GV, at least one of the vent apertures 221, 222, 223 is in spatial communication with a gas located within the storage cavity 211 of the housing 210 rather than with a fluid located within the storage cavity 211 of the housing 210.

Figure 14A:
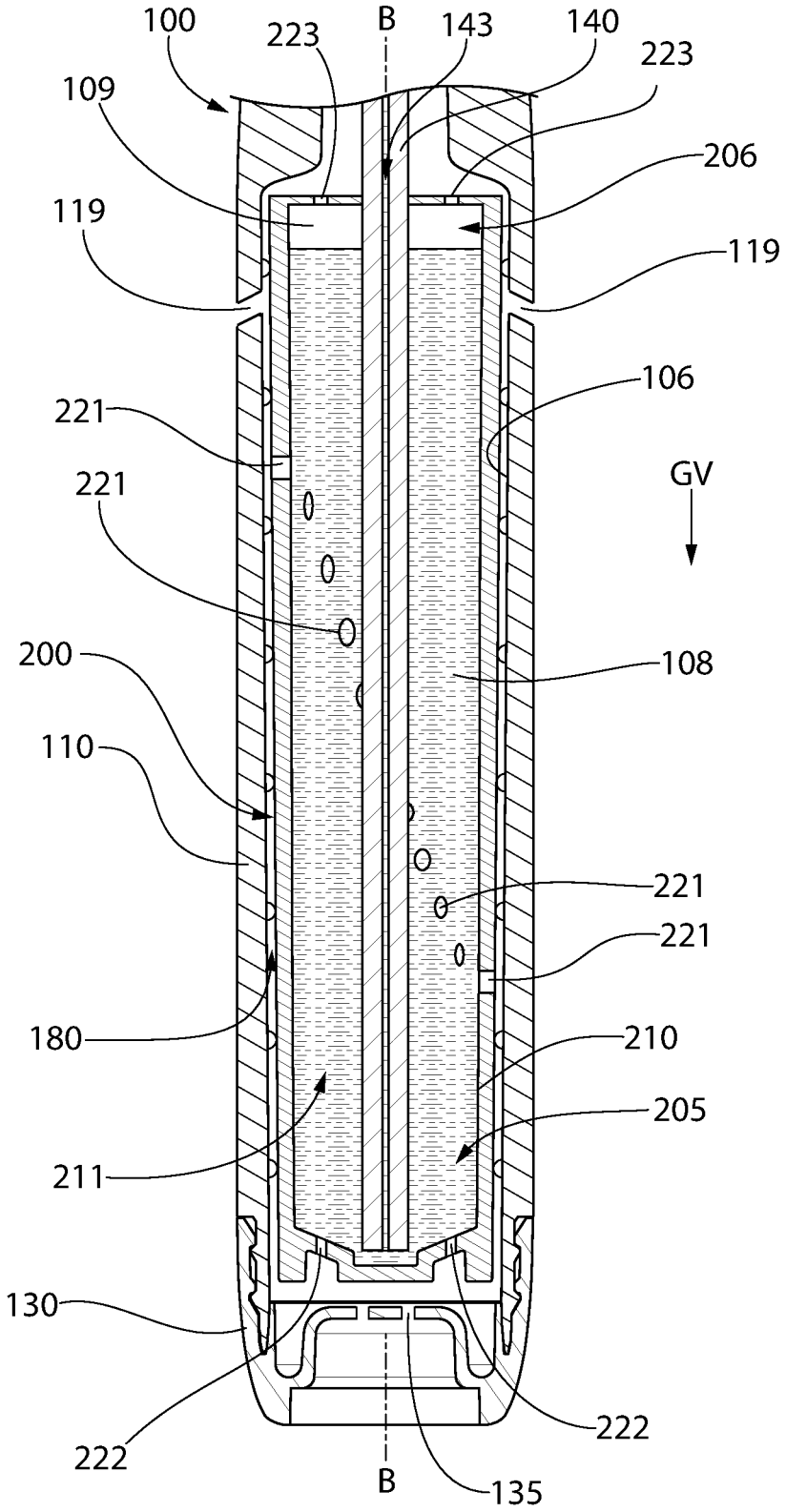
FIG. 14A is a close-up view of area XIII of FIG. 4 in a first orientation.

FIG. 14A illustrates the fluid supply apparatus 200 located within the personal care implement 100 with the housing 210 positioned in an upright orientation. As shown here, the storage cavity 211 of the housing 210 has a total volume that is occupied by a fluid 108 and a gas 109. Specifically, a first portion of the total volume of the storage cavity 211 of the housing 210 is occupied by the fluid 108 and a second portion of the total volume of the storage cavity 211 of the housing 210 is occupied by the gas 109. In the exemplified embodiment, the first portion of the total volume of the storage cavity 211 that is occupied by the fluid 108 is a majority of the total volume such that the fluid occupies a majority of the total volume of the storage cavity 211. In one embodiment, the fluid 109 occupies at least eighty percent (80%) of the total volume of the storage cavity 211. In another embodiment, the fluid 109 occupies at least eight-five percent (85%), or at least ninety percent (90%) or at least ninety-five percent (95%) of the total volume of the storage cavity 211. Of course, as the fluid 108 supply apparatus 200 is used, the fluid 109 contained within the storage cavity 211 becomes depleted and the percentage of the total volume that is taken up by the fluid 108 decreases while the percentage of the total volume that is taken up by the gas 109 increases.

In one specific embodiment, the total volume of the storage cavity 210 may be between 5 ml and 10 ml, more specifically between 6 ml and 8 ml, and still more specifically approximately 7ml. Furthermore, in certain embodiments prior to use the fluid 108 will encompass approximately 95% (about 6.7 ml when the total volume is 7 ml) of the total volume. Of that 6.7 ml of the fluid 108, a portion will prime the capillary member 240 and the applicator 150, leaving approximately 6 ml of the fluid 108 within the storage cavity 210 (based on the storage cavity 210 having a total volume of 7 ml, the exact numbers may change while the percentages may remain the same). Thus, after priming and at or before first use by an end user, between 80%-90%, and more specifically approximately 85% of the total volume of the storage cavity 210 will be taken up by the fluid 108, the remaining 10%-20%, and more specifically 15%, being taken up by the gas/air 109.

With the housing 210 positioned in the upright orientation such that the gravitational vector GV is parallel to the cavity axis B-B, the fluid 108 in the storage cavity 211 is located in a bottom portion 205 of the storage cavity 211 and the gas 109 is located in the top portion 206 of the storage cavity 211 above the free surface of the liquid 108. In this example and orientation of the housing 210, the vent apertures 223 are in spatial communication with the gas 109 in the storage cavity 211. Thus, if there were an increase in temperature or a decrease in pressure, the gas 109 will flow out through the vent apertures 223 into the gap 180 and then out through one of the vent openings 119, 135 to the external atmosphere. Thus, because one of the vent apertures 223 is in spatial communication with the gas 109 (i.e., air pocket) within the storage cavity 211, the gas 109 is permitted to pass to the external atmosphere rather than having it exert a pressure on the fluid 108 which could create a leak situation.

In certain embodiments, the gas 109 in the storage cavity 211 is air (i.e., oxygen, a mixture of oxygen, nitrogen, and small amounts of other gases, or the like). Furthermore, the fluid 109 can be any fluid that is desired to be dispensed for application to a surface (such as a biological surface) depending on the end use. For example, when the desired application site is a user's oral cavity, the fluid 108 may be one that provides a benefit to a user's oral surfaces (i.e., a benefit agent) such as a sensorial or therapeutic benefit. For example without limitation, the fluid 108 may be a mouthwash, a dentifrice, a tooth whitening agent such as peroxide containing tooth whitening compositions, or the like. Other contemplated fluids that can be stored in the storage cavity 211 include, for example without limitation, antibacterial agents; oxidative or whitening agents; enamel strengthening or repair agents; tooth erosion preventing agents; tooth sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof In certain embodiments the oral care material is free of (i.e., is not) toothpaste. Instead, the oral care material in such embodiments is intended to provide benefits in addition to merely brushing one's teeth. Other suitable oral care materials could include lip balm or other materials that are typically available in a semi-solid state. Furthermore, in still other embodiments the first fluid 103 can be a natural ingredient, such as for example without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+.

Thus, when the fluid supply apparatus 200 is stored in an oral care implement or toothbrush, any of the above fluids may be desirable for use as the fluid 108. In other embodiments the personal care implement 100 may not be a toothbrush. Thus, the fluid 108 can be any other type of fluid that has beneficial results when dispensed in accordance with its end use or the end use of the product/implement with which it is associated. For example, the fluid 108 may be hair gel when the implement is a hairbrush, make-up (i.e., mascara or the like) when the implement is a make-up applicator, shaving cream when the implement is a razor, anti-acne cream when the implement is a skin or face scrubber, or the like. Furthermore, as described herein in some embodiments the fluid supply apparatus 200 may not be associated with a personal care implement at all. Thus, the fluid 108 may be modified as desired to be any type of fluid that is desired to be dispensed in accordance with the teachings set forth herein even if it is dispensed directly from the fluid supply apparatus 200 rather than through a personal care implement 100.

Figure 14B:
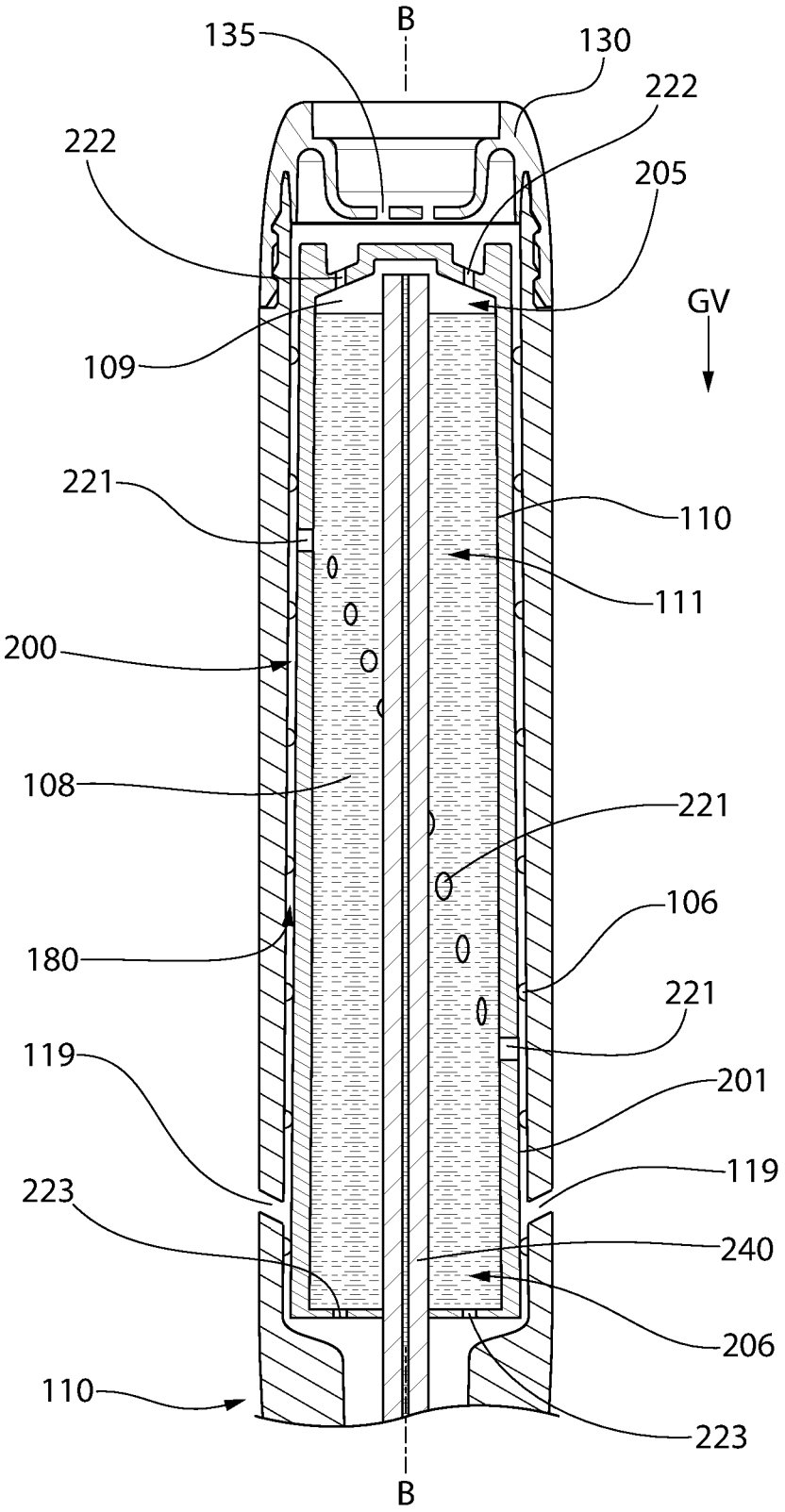
FIG. 14B is a close-up view of area XIII of FIG. 4 in a second orientation.

FIG. 14B illustrates the same thing as FIG. 14A except the personal care implement 100 and the fluid supply apparatus 200 therein have been flipped 180° so that they are upside-down relative to FIG. 14A. Thus, in this embodiment the cavity axis B-B remains parallel to the gravitational vector GV, except here the housing 210 is upside-down such that its top portion 206 is facing downward and its bottom portion 205 is facing upward. In this embodiment, the same amount of the total volume of the storage cavity 211 is occupied by the fluid 108 and the gas 109 as with the embodiment of FIG. 14A (i.e., a majority of the total volume is occupied by the fluid 108 and the remainder by the gas 109).

With the housing 210 positioned in the upside-down orientation, the fluid 108 in the storage cavity 211 is located in the top portion 206 of the storage cavity 211 and the gas 109 is located in the bottom portion 205 of the storage cavity 211 (which is above the free surface of the liquid 108 due to the upside-down orientation). In this example and orientation of the housing 210, one of the second vent apertures 222 is in spatial communication with the gas 109 in the storage cavity 211. Thus, if there were an increase in temperature or a decrease in pressure, the gas 109 will flow out through the second vent aperture(s) 222 into the gap 180 and then out through one of the vent openings 119, 135 to the external atmosphere. Thus, because one of the second vent apertures 222 is in spatial communication with the gas 109 (i.e., air pocket) within the storage cavity 211, the gas 109 is permitted to pass to the external atmosphere rather than having it exert a pressure on the fluid 108 which could create a leak situation.

Figure 14C:
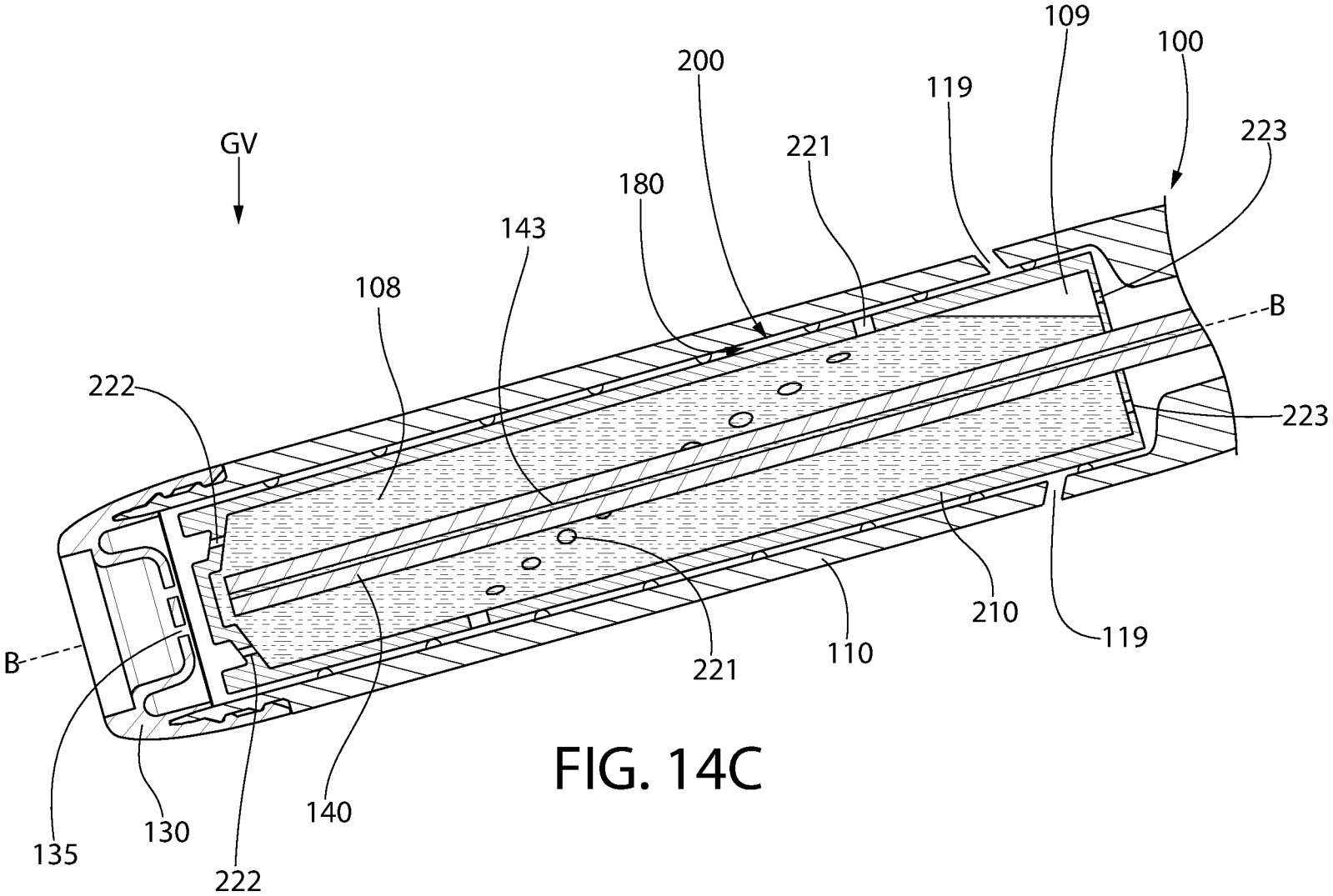
FIG. 14C is a close-up view of area XIII of FIG. 4 in a third orientation.

FIG. 14C illustrates the same thing as FIGS. 14A and 14B except the personal care implement 100 and the fluid supply apparatus 200 have been tilted so that the cavity axis B-B is oriented obliquely to the gravitational vector GV. Although one tilt position is illustrated in FIG. 14C, the device will operate similarly in any of the infinite tilt orientations at which the cavity axis B-B is oblique to the gravitational vector GV. Furthermore, at any orientation shown, the personal care implement 100 and the fluid supply apparatus 200 can be rotated (with the cavity axis B-B or the longitudinal axis A-A as the rotational axis) 360° with the device still properly functioning to prevent a leak situation. In the embodiment of FIG. 14C, the same amount of the total volume of the storage cavity 211 is occupied by the fluid 108 and the gas 109 as with the embodiments of FIGS. 14A and 14B (i.e., a majority of the total volume is occupied by the fluid 108 and the remainder by the gas 109).

With the housing 210 positioned in this tilted orientation, the fluid 108 in the storage cavity 211 is located in an upper corner of the storage cavity 211 near the top end or second end wall 216. In this example and orientation of the housing 210, one of the third vent apertures 223 is in spatial communication with the gas 109 in the storage cavity 211. Thus, if there were an increase in temperature or a decrease in pressure, the gas 109 will flow out through the third vent aperture 223 into the gap 180 and then out through one of the vent openings 119, 135 to the external atmosphere. Thus, because one of the third vent apertures 223 is in spatial communication with the gas (i.e., air pocket) within the storage cavity 211, the gas 109 is permitted to pass to the external atmosphere rather than having it exert a pressure on the fluid 108 which could create a leak situation.

Figure 14D:
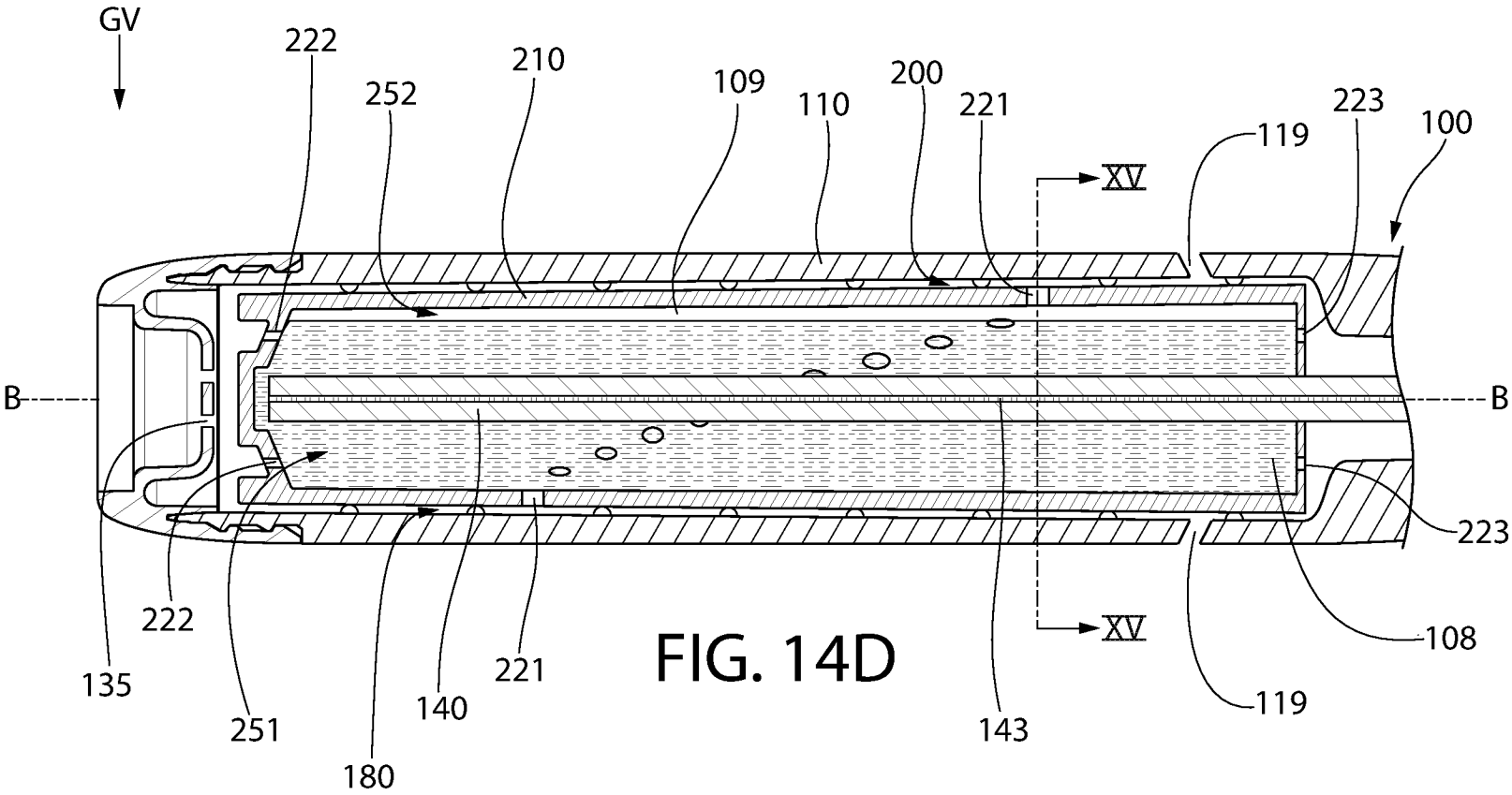
FIG. 14D is a close-up view of area XIII of FIG. 4 in a fourth orientation.

FIG. 14D illustrates the same thing as FIGS. 14A-14C except the personal care implement 100 and the fluid supply apparatus 200 have been tilted so that the cavity axis B-B is oriented orthogonal to the gravitational vector GV. In the embodiment of FIG. 14C, the same amount of the total volume of the storage cavity 211 is occupied by the fluid 108 and the gas 109 as with the previously described embodiments.

Figure 15:
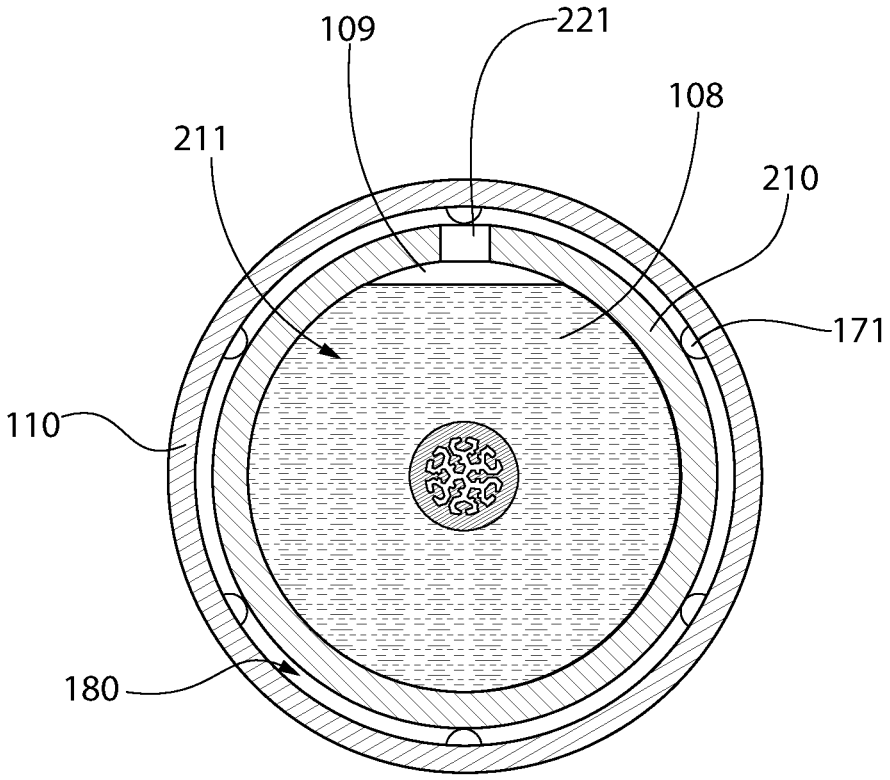
FIG. 15 is a cross-sectional view taken along line XV of FIG. 14D.

With the housing 210 positioned in this orientation, the fluid 108 in the storage cavity 211 falls by gravity to the right-side portion 251 of the storage cavity 211 and the left-most portion 252 of the storage cavity 211 is filled with the gas 109. In this example and orientation of the housing 210, at least one of the first vent apertures 221 is in spatial communication with the gas 109 in the storage cavity 211. Thus, if there were an increase in temperature or a decrease in pressure, the gas 109 will flow out through the first vent aperture 221 into the gap 180 and then out through one of the vent openings 119, 135 to the external atmosphere. Thus, because one of the first vent apertures 221 is in spatial communication with the gas (i.e., air pocket) within the storage cavity 211, the gas 109 is permitted to pass to the external atmosphere rather than having it exert a pressure on the fluid 108 which could create a leak situation. FIG. 15 further illustrates the spatial communication between the gas 109 in the storage cavity 211 and one of the first vent apertures 221 with the housing 210 in the orientation of FIG. 14D such that the cavity axis B-B is perpendicular to the gravitational vector GV.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A fluid supply apparatus comprising:

a housing defining a storage cavity having a total volume, the storage cavity extending along a cavity axis from a first end to a second end;

a store of a fluid in the storage cavity and occupying a portion of the total volume, a remaining portion of the total volume occupied by a gas;

a capillary member in fluid coupling with the store of the fluid, the capillary member extending through the housing;

a plurality of vent apertures in the housing, each of the vent apertures forming a passageway between the storage cavity and an external atmosphere and configured such that the fluid cannot flow through the vent apertures at ambient temperature and pressure equilibrium between the storage cavity and the external atmosphere; and the vent apertures located and arranged on the housing such that irrespective of vertical and angular orientation of the housing relative to a gravitational vector at least one of the vent apertures is in spatial communication with the gas.

2. The fluid supply apparatus according to claim 1 wherein the store of the fluid occupies a majority of the total volume.

3. The fluid supply apparatus according to claim 2 wherein the store of the fluid occupies at least eighty-percent of the total volume.

4. The fluid supply apparatus according to claim 1 wherein the vent apertures comprise a plurality of first vent apertures in a sidewall of the housing and arranged in a spaced apart manner to circumferentially surround the cavity axis.

5. The fluid supply apparatus according to claim 4 wherein the first vent apertures are angularly equispaced from one another.

6. The fluid supply apparatus according to claim 4 wherein adjacent ones of the first vent apertures are separated by an angle that is less than or equal to 60 degrees.

7. The fluid supply apparatus according to claim 4 wherein the first vent apertures lie in a reference plane that is oblique to the cavity axis.

8. The fluid supply apparatus according to claim 4 wherein the first vent apertures lie in a reference plane that is orthogonal to the cavity axis.

9. The fluid supply apparatus according to claim 4 wherein the first vent apertures are arranged in a helical pattern about the cavity axis.

10. The fluid supply apparatus according to claim 4 wherein at least one of the first vent apertures is located along a portion of the sidewall that is radially-most from the cavity axis.

11. The fluid supply apparatus according to claim 4 wherein the first vent apertures are located on a middle portion of the housing.

12. The fluid supply apparatus according to claim 4 wherein the vent apertures comprise at least one second vent aperture located adjacent the first end of the storage cavity and at least one third vent aperture located adjacent the second end of the storage cavity, wherein the second vent aperture is located on a first end wall of the housing and the third aperture is located on a second end wall of the housing.

13. An oral care implement comprising the fluid supply apparatus according to claim 1.

14. The oral care implement according to claim 13 further comprising:

a head;

a handle; and an applicator in fluid coupling with the capillary member.

15. The oral care implement according to claim 14 wherein the applicator is located on the head.

16. The oral care implement according to claim 14 further comprising:

the handle including a handle cavity;

the fluid supply apparatus positioned within the handle cavity so that a gap exists between the housing of the fluid supply apparatus and an inner surface of the handle;

the vent apertures of the fluid supply apparatus in spatial communication with the gap; and at least one handle vent aperture forming a passageway between the storage cavity and an external atmosphere.

17. A fluid supply apparatus comprising:

a housing defining a storage cavity extending along a cavity axis from a first end to a second end, a store of a fluid disposed within the storage cavity;

a capillary member in fluid coupling with the store of the fluid, the capillary member extending through the housing;

a plurality of vent apertures in the housing, the vent apertures comprising:

a plurality of first vent apertures in a sidewall of the housing and arranged in a spaced apart manner to circumferentially surround the cavity axis;

at least one second vent aperture located adjacent the first end of the storage cavity; and at least one third vent aperture located adjacent the second end of the storage cavity.

18. The fluid supply apparatus according to claim 17 wherein the first vent apertures lie in a reference plane that is oblique to the cavity axis, or wherein the first vent apertures lie in a reference plane that is orthogonal to the cavity axis, or wherein the first vent apertures are arranged in a helical pattern about the cavity axis.

19. The fluid supply apparatus according to claim 17 wherein at least one of the first vent apertures is located along a portion of the sidewall that is radially-most from the cavity axis.

20. The fluid supply apparatus according to claim 17 wherein the second vent aperture is located on a first end wall of the housing and the third vent aperture is located on a second end wall of the housing.

* * * * *